US008337243B2

(12) United States Patent
Elkhatib et al.

(10) Patent No.: US 8,337,243 B2
(45) Date of Patent: Dec. 25, 2012

(54) CABLE ASSEMBLY WITH A MATERIAL AT AN EDGE OF A SUBSTRATE

(75) Inventors: Hecham K. Elkhatib, Aurora, IL (US); James L. McGrath, Bloomingdale, IL (US); David W. Mendenhall, Naperville, IL (US); William J. MacKillop, Wheaton, IL (US); Alan A. Raclawski, Schamburg, IL (US)

(73) Assignee: Cinch Connectors, Inc., Lombard, IL (US)

( * ) Notice: Subject to any disclaimer, the term of this patent is extended or adjusted under 35 U.S.C. 154(b) by 0 days.

(21) Appl. No.: 13/090,103

(22) Filed: Apr. 19, 2011

(65) Prior Publication Data

US 2011/0195592 A1 Aug. 11, 2011

Related U.S. Application Data

(62) Division of application No. 12/388,383, filed on Feb. 18, 2009, now Pat. No. 8,011,950.

(51) Int. Cl.
*H01R 9/05* (2006.01)

(52) U.S. Cl. ..... 439/581

(58) Field of Classification Search ..... 439/581, 439/98, 497, 579, 607.46; 174/250–254, 174/260, 261, 264; 361/760, 799, 800, 816, 361/818

See application file for complete search history.

(56) References Cited

U.S. PATENT DOCUMENTS 2,959,758 A 11/1960 Geshner et al.
3,612,744 A 10/1971 Thomas
3,700,825 A 10/1972 Taplin et al.
3,973,817 A 8/1976 Stalley et al.
4,303,291 A 12/1981 Dines
4,448,466 A 5/1984 Porter
4,513,170 A 4/1985 Apodaca
4,551,576 A 11/1985 Rich
4,642,592 A 2/1987 Beeck
4,644,092 A 2/1987 Gentry
4,678,864 A 7/1987 Cox
4,698,457 A 10/1987 Bordbar
4,708,415 A 11/1987 White
4,734,041 A 3/1988 Bruchmann et al.
4,780,603 A 10/1988 Hamada (Continued)

OTHER PUBLICATIONS

U.S. Appl. No. 13/090,898, filed Apr. 20, 2011.

*Primary Examiner* — Edwin A. Leon
*Assistant Examiner* — Harshad Patel
(74) *Attorney, Agent, or Firm* — Leydig, Voit & Mayer, Ltd.

(57) ABSTRACT

The cable assembly may include a plug connector, a cable, and a connector. The plug connector may include a housing and a board assembly. The board assembly may include a printed circuit board. The edge of the printed circuit board may be enclosed with a material. The material may be an overmolded plastic or a coating of a material. In order to reduce the crosstalk in the areas where the cable shield is removed, a shielding assembly may be used. The shielding assembly may provide 360 degrees of shielding for the wire pair at the location where the cable shield is removed. The printed circuit board may have a trace layer, a core layer, and a ground plane layer. The ground plane layer may have a portion which is a solid layer and another portion which is a non-solid layer.

26 Claims, 42 Drawing Sheets

U.S. PATENT DOCUMENTS

| | | | | |
|---|---|---|---|---|
| 4,782,193 | A | | 11/1988 | Linsker |
| 4,806,103 | A | | 2/1989 | Kniese et al. |
| 4,816,426 | A | | 3/1989 | Bridges et al. |
| 4,820,196 | A | | 4/1989 | Roselle et al. |
| 4,829,667 | A | | 5/1989 | Thompson et al. |
| 4,855,537 | A | | 8/1989 | Nakai et al. |
| 4,883,433 | A | | 11/1989 | Lane |
| 4,910,867 | A | | 3/1990 | Weigert |
| 4,941,830 | A | | 7/1990 | Tkazyik et al. |
| 5,003,374 | A | | 3/1991 | Vokoun, III |
| 5,079,069 | A | | 1/1992 | Howard et al. |
| 5,094,627 | A | | 3/1992 | Uekido |
| 5,114,364 | A | | 5/1992 | Hunter |
| 5,136,366 | A | | 8/1992 | Worp et al. |
| 5,212,348 | A | | 5/1993 | Gibson |
| 5,236,372 | A | | 8/1993 | Yunoki et al. |
| 5,246,391 | A | | 9/1993 | Seidler |
| 5,258,331 | A | | 11/1993 | Masumoto et al. |
| 5,267,868 | A | | 12/1993 | Wolff, Jr. |
| 5,272,600 | A | | 12/1993 | Carey |
| 5,281,762 | A | | 1/1994 | Long et al. |
| 5,286,215 | A | | 2/1994 | Dewey et al. |
| 5,300,899 | A | | 4/1994 | Suski |
| 5,302,553 | A | | 4/1994 | Abbott et al. |
| 5,306,158 | A | | 4/1994 | Endo et al. |
| 5,315,485 | A | | 5/1994 | Magill et al. |
| 5,331,515 | A | | 7/1994 | Ewers |
| 5,364,292 | A | * | 11/1994 | Bethurum ..... 439/607.02 |
| 5,406,027 | A | | 4/1995 | Matsumoto et al. |
| 5,407,366 | A | | 4/1995 | Briones et al. |
| 5,410,107 | A | | 4/1995 | Schaper |
| 5,438,480 | A | | 8/1995 | Yamashita |
| 5,446,243 | A | | 8/1995 | Crowder et al. |
| 5,468,920 | A | | 11/1995 | August |
| 5,470,238 | A | | 11/1995 | Walden |
| 5,475,379 | A | | 12/1995 | George et al. |
| 5,478,259 | A | | 12/1995 | Noschese |
| 5,525,071 | A | | 6/1996 | Obara et al. |
| 5,550,323 | A | | 8/1996 | Gainey |
| 5,594,204 | A | | 1/1997 | Taylor et al. |
| 5,608,192 | A | | 3/1997 | Moriizumi et al. |
| 5,631,807 | A | | 5/1997 | Griffin |
| 5,633,479 | A | | 5/1997 | Hirano |
| 5,675,299 | A | | 10/1997 | Suski |
| 5,677,511 | A | | 10/1997 | Taylor et al. |
| 5,682,124 | A | | 10/1997 | Suski |
| 5,711,686 | A | | 1/1998 | O'Sullivan et al. |
| 5,772,465 | A | | 6/1998 | Hwang et al. |
| 5,775,940 | A | * | 7/1998 | Tanigawa ..... 439/507 |
| 5,812,380 | A | | 9/1998 | Frech et al. |
| 5,818,315 | A | | 10/1998 | Moongilan |
| 5,819,398 | A | | 10/1998 | Wakefield |
| 5,895,292 | A | | 4/1999 | Affeltranger |
| 5,912,809 | A | | 6/1999 | Steigerwald et al. |
| 5,934,940 | A | | 8/1999 | Maranto et al. |
| 5,940,277 | A | | 8/1999 | Farnworth et al. |
| 5,951,804 | A | | 9/1999 | Kweon et al. |
| 5,959,247 | A | | 9/1999 | Armstrong et al. |
| 5,963,434 | A | | 10/1999 | Jonsson et al. |
| 5,980,321 | A | | 11/1999 | Cohen et al. |
| 5,981,870 | A | | 11/1999 | Barcley et al. |
| 5,982,249 | A | | 11/1999 | Bruns |
| 5,984,727 | A | | 11/1999 | Wu et al. |
| 6,024,597 | A | * | 2/2000 | Lok ..... 439/497 |
| 6,031,185 | A | * | 2/2000 | Bouveret et al. ..... 174/84 R |
| 6,039,606 | A | | 3/2000 | Chiou |
| 6,058,022 | A | | 5/2000 | Gianni et al. |
| 6,091,606 | A | | 7/2000 | Farnworth et al. |
| 6,127,977 | A | | 10/2000 | Cohen |
| 6,144,560 | A | | 11/2000 | Farnworth et al. |
| 6,147,680 | A | | 11/2000 | Tareev |
| 6,188,016 | B1 | | 2/2001 | Enstrom et al. |
| 6,193,555 | B1 | | 2/2001 | Chang |
| 6,210,229 | B1 | | 4/2001 | Lai |
| 6,210,235 | B1 | | 4/2001 | Wu |
| 6,241,555 | B1 | | 6/2001 | Okuyama et al. |
| 6,255,600 | B1 | | 7/2001 | Schaper |
| 6,264,500 | B1 | | 7/2001 | Kawabe |
| RE37,368 | E | | 9/2001 | Huppenthal et al. |
| 6,295,209 | B1 | | 9/2001 | Farnworth et al. |
| 6,297,460 | B1 | | 10/2001 | Schaper |
| 6,307,749 | B1 | | 10/2001 | Daanen et al. |
| 6,307,756 | B1 | | 10/2001 | Liu et al. |
| 6,319,019 | B1 | | 11/2001 | Kwon et al. |
| 6,343,956 | B2 | | 2/2002 | Stickney |
| 6,348,722 | B1 | | 2/2002 | Yoshikoshi |
| 6,368,154 | B1 | | 4/2002 | Hirata et al. |
| 6,380,485 | B1 | | 4/2002 | Beaman et al. |
| 6,380,487 | B1 | | 4/2002 | Hollenbeck et al. |
| 6,386,919 | B2 | | 5/2002 | Medina et al. |
| 6,388,200 | B2 | | 5/2002 | Schaper |
| 6,431,915 | B1 | | 8/2002 | Ko |
| 6,437,991 | B1 | | 8/2002 | Rog et al. |
| 6,437,993 | B1 | | 8/2002 | Burgdorf et al. |
| 6,439,919 | B1 | | 8/2002 | Yasufuku et al. |
| 6,444,922 | B1 | | 9/2002 | Kwong |
| 6,450,835 | B1 | | 9/2002 | Lee |
| 6,452,549 | B1 | | 9/2002 | Lo |
| 6,459,517 | B1 | | 10/2002 | Duncan et al. |
| 6,464,538 | B2 | | 10/2002 | Miyazaki et al. |
| 6,476,493 | B2 | | 11/2002 | Or-Bach et al. |
| 6,483,043 | B1 | | 11/2002 | Kline |
| 6,489,563 | B1 | | 12/2002 | Zhao et al. |
| 6,496,377 | B1 | | 12/2002 | Happ et al. |
| 6,512,288 | B1 | | 1/2003 | Shin et al. |
| 6,520,802 | B1 | | 2/2003 | Mitra |
| 6,533,609 | B2 | | 3/2003 | Koide |
| 6,542,382 | B2 | | 4/2003 | BuAbbud et al. |
| 6,549,427 | B1 | | 4/2003 | Johnston |
| 6,559,377 | B1 | | 5/2003 | Noda et al. |
| 6,575,761 | B1 | | 6/2003 | Regnier |
| 6,579,125 | B1 | | 6/2003 | Nagahata et al. |
| 6,582,252 | B1 | * | 6/2003 | Lin ..... 439/607.46 |
| 6,590,466 | B2 | | 7/2003 | Lin et al. |
| 6,602,078 | B2 | | 8/2003 | Kwark |
| 6,607,308 | B2 | | 8/2003 | Dair et al. |
| 6,613,413 | B1 | | 9/2003 | Japp et al. |
| 6,641,429 | B1 | | 11/2003 | Wu |
| 6,657,130 | B2 | | 12/2003 | Van Dyke et al. |
| 6,659,655 | B2 | | 12/2003 | Dair et al. |
| 6,663,415 | B1 | | 12/2003 | Wu |
| 6,663,432 | B2 | | 12/2003 | Inagawa |
| 6,670,559 | B2 | | 12/2003 | Centola et al. |
| 6,685,511 | B2 | | 2/2004 | Akama et al. |
| 6,686,657 | B1 | | 2/2004 | Kline |
| 6,699,074 | B1 | | 3/2004 | Wu et al. |
| 6,717,822 | B1 | | 4/2004 | Miks et al. |
| 6,722,924 | B1 | | 4/2004 | Zhou et al. |
| 6,744,639 | B1 | | 6/2004 | Branch et al. |
| 6,778,406 | B2 | | 8/2004 | Grube et al. |
| 6,779,260 | B1 | | 8/2004 | Brandenburg et al. |
| 6,780,054 | B2 | | 8/2004 | Yip et al. |
| 6,781,228 | B2 | | 8/2004 | Ishikawa et al. |
| 6,784,531 | B2 | | 8/2004 | Tsuk et al. |
| 6,786,742 | B2 | | 9/2004 | Matsuoka |
| 6,796,839 | B1 | | 9/2004 | Wu |
| 6,800,939 | B2 | | 10/2004 | Schaper |
| 6,803,656 | B2 | * | 10/2004 | Moden et al. ..... 257/730 |
| 6,812,048 | B1 | | 11/2004 | Kline |
| 6,814,588 | B1 | | 11/2004 | Dunlavy |
| 6,815,712 | B1 | | 11/2004 | Kline |
| 6,821,150 | B2 | | 11/2004 | Hall et al. |
| 6,851,953 | B2 | | 2/2005 | Kamiyamane |
| 6,855,891 | B2 | | 2/2005 | Eguchi et al. |
| 6,870,746 | B2 | | 3/2005 | Leeson et al. |
| 6,874,953 | B2 | | 4/2005 | Dair et al. |
| 6,893,270 | B2 | | 5/2005 | Sercu |
| 6,899,546 | B2 | | 5/2005 | Longueville et al. |
| 6,900,383 | B2 | | 5/2005 | Babb et al. |
| 6,910,874 | B2 | | 6/2005 | Bolken et al. |
| 6,916,198 | B2 | * | 7/2005 | Wu et al. ..... 439/497 |
| 6,927,083 | B2 | | 8/2005 | Kline |
| 6,940,022 | B1 | | 9/2005 | Vinciarelli et al. |
| 6,967,494 | B2 | | 11/2005 | Kline |
| 6,972,968 | B2 | | 12/2005 | Hwang |
| 6,974,334 | B2 | | 12/2005 | Hung |
| 6,997,749 | B1 | | 2/2006 | Harubayashi |

7,001,217 B2 2/2006 Bright et al.
7,004,793 B2 2/2006 Scherer et al.
7,026,997 B2 4/2006 Rahola
7,029,331 B1 4/2006 Lai
7,052,292 B2 5/2006 Hsu et al.
7,096,451 B2 8/2006 Donaldson et al.
7,097,505 B1 8/2006 Shanahan et al.
7,114,981 B1 10/2006 Huang et al.
7,118,409 B2 10/2006 Kuroda et al.
7,121,869 B2 10/2006 Chen
7,121,890 B2 10/2006 Chang
7,134,914 B1 11/2006 Wu
7,145,083 B2 12/2006 Kwong et al.
7,148,850 B2 12/2006 Puente Baliarda et al.
7,151,319 B2 12/2006 Iida et al.
7,173,193 B2 2/2007 Brodsky et al.
7,189,929 B2 3/2007 Benson
7,202,822 B2 4/2007 Baliarda et al.
7,230,835 B1 6/2007 Ahmad
7,237,218 B2 6/2007 Shrowty et al.
7,240,314 B1 7/2007 Leung
7,242,592 B2 7/2007 Payne et al.
7,245,196 B1 7/2007 Baliarda et al.
7,254,038 B2 8/2007 Drako
7,255,610 B2 8/2007 Oohashi et al.
7,259,336 B2 8/2007 Wyrzykowska et al.
7,259,968 B2 8/2007 Wright
7,264,507 B2 9/2007 Beckman et al.
7,267,579 B1 9/2007 Wu
7,276,668 B2 10/2007 Lee et al.
7,286,372 B2 10/2007 Aronson et al.
7,294,024 B2 11/2007 Hammond, Jr. et al.
7,306,476 B2 12/2007 Gerlich et al.
7,306,487 B1 12/2007 Chang
7,312,404 B2 12/2007 Cherniski et al.
7,314,379 B2 1/2008 Chen et al.
7,348,498 B2 3/2008 Barr et al.
7,354,300 B2 4/2008 Shindo
7,354,311 B2 4/2008 Festag et al.
7,364,465 B2 * 4/2008 Wu ..... 439/607.55
7,375,286 B2 5/2008 Honjo
7,387,515 B2 6/2008 Watanabe
7,411,134 B1 8/2008 Steinfeld et al.
7,411,283 B2 8/2008 Hockanson et al.
7,427,718 B2 9/2008 Ng et al.
7,435,132 B1 * 10/2008 Fong et al. ..... 439/497
7,436,008 B2 10/2008 Ho
7,445,471 B1 11/2008 Scherer et al.
7,462,071 B1 12/2008 Wu
7,465,882 B2 12/2008 Becker et al.
7,466,564 B2 12/2008 Harada et al.
7,819,675 B2 10/2010 Ko et al.
2001/0014546 A1 * 8/2001 Yasufuku et al. ..... 439/55
2001/0038527 A1 11/2001 DiBene, II et al.
2002/0167804 A1 11/2002 Towle
2003/0142480 A1 7/2003 Spitz et al.
2003/0178215 A1 9/2003 Chu et al.
2005/0000726 A1 1/2005 Kimata et al.
2005/0090150 A1 4/2005 Beckmann et al.
2005/0098338 A1 5/2005 Kitae et al.
2005/0106938 A1 5/2005 Nishio et al.
2006/0046569 A1 3/2006 Kondou et al.
2006/0144616 A1 7/2006 Lin et al.
2006/0162156 A1 7/2006 Reed
2006/0189180 A1 8/2006 Lang et al.
2006/0199434 A1 9/2006 Chang
2006/0228935 A1 10/2006 Wen et al.
2007/0082547 A1 4/2007 Komoto et al.
2007/0181337 A1 8/2007 Miller
2007/0206364 A1 9/2007 Swei et al.
2007/0278001 A1 12/2007 Mayder et al.
2008/0009189 A1 1/2008 Wu
2008/0087456 A1 4/2008 Schuette
2008/0153328 A1 6/2008 Ho
2008/0158840 A1 7/2008 Chen et al.
2008/0212292 A1 9/2008 Yu et al.
2009/0197467 A1 8/2009 Ko et al.

* cited by examiner

CABLE ASSEMBLY WITH A MATERIAL AT AN EDGE OF A SUBSTRATE

RELATED APPLICATION

This patent application is a divisional of U.S. patent application Ser. No. 12/388,383, filed on Feb. 18, 2009, which is incorporated by reference in its entirety herein.

BACKGROUND

Cable assemblies may be used to connect one system component with another system component. The cable assembly may include a plug connector for connection with a receptacle in a component. The wires in the cable assembly may be shielded in order to prevent cross-talk. The cable assemblies may also need to maintain a constant impedance along the plug connector.

BRIEF SUMMARY

The cable assembly may include a plug connector and a cable. The plug connector may include a back shell, a cover, a board assembly, and a latch assembly. The board assembly may include a substrate. The substrate may be a printed circuit board.

Printed circuit boards are usually manufactured in standard panel sizes and the panel may include two or more printed circuit boards. The pads and traces of the printed circuit boards may be connected together through tie-bars. Each individual printed circuit board is then cut off from the panel at the tie-bars. The printed circuit board may then have the chamfers applied. Due to the cut-off process and/or the chamfering process, the exposed edges of the tie bars and the fiberglass of the printed circuit board can be found on the cut-off edge of the printed circuit board. In order to prevent a loose fiber from entering the contact area and/or to prevent the rough tie bar edge from removing the plating on the mating contact, the edge of the printed circuit board may be enclosed with a material. The material may either be an overmolded plastic or a coating of material, such as, a conformal coating. The material may encapsulate the fibers on the edge of the printed circuit board in order to prevent fibers from separating from the edge. In addition, the material may provide a transition between the printed circuit board edge and the pads.

The cable assembly may include one or more pairs of wires. Cross talk between wire pairs that are inside the cable is minimal because each wire pair is wrapped by a conductive shield. In order to reduce the crosstalk in the areas where the cable shield is removed, a shielding assembly may be used. In one embodiment, the shielding assembly may include a top shield, a bottom shield and an intermediate shield. The shielding assembly may provide 360 degrees of shielding for the wire pair.

In another embodiment of a shielding assembly, the shield assembly may include a top shield and a bottom shield. The printed circuit board may have one or more ground planes. The ground plane may be located on the upper surface of the printed circuit board. The shield assembly and the ground plane may provide 360 degrees of shielding for the wire pairs.

The printed circuit board may be made of several layers. The printed circuit board may have a trace layer, a core layer, and a ground plane layer. The ground plane layer may have a portion which is a solid layer and another portion which is a non-solid layer. The non-solid portion may have portions with a conductive material and other portions with openings. The non-solid portion of the ground plane may increase the impedance of the pads which are located above the non-solid portion. Thus, smaller traces may be used above the solid portion of the ground plane and larger pads may be used above the non-solid portion of the ground plane so that the impedance may remain the same along the printed circuit board.

Several cable assemblies may be connected to a back plane which includes receptacles for the cable assemblies. In order to facilitate the insertion and/or removal of a cable assembly, the end portion of the cable assembly may include angled portions. The angled portions allow the user to push and/or grasp the cable assembly for insertion and/or removal of the cable assembly. The angled portions may have a series of protrusions. The protrusions may facilitate the pushing and/or grasping of the cable assembly.

DESCRIPTION

Figure 1:
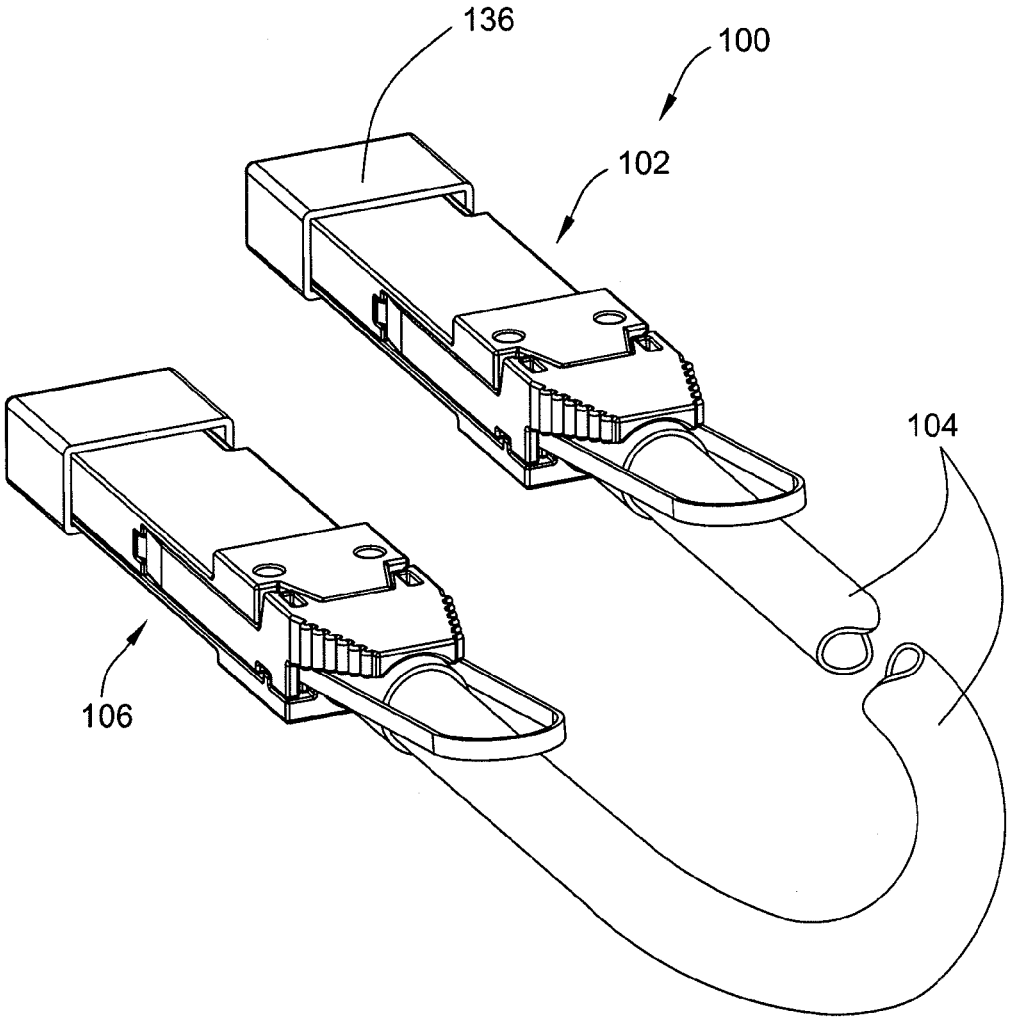
FIG. 1 is a perspective view of a cable assembly.
Figure 2:
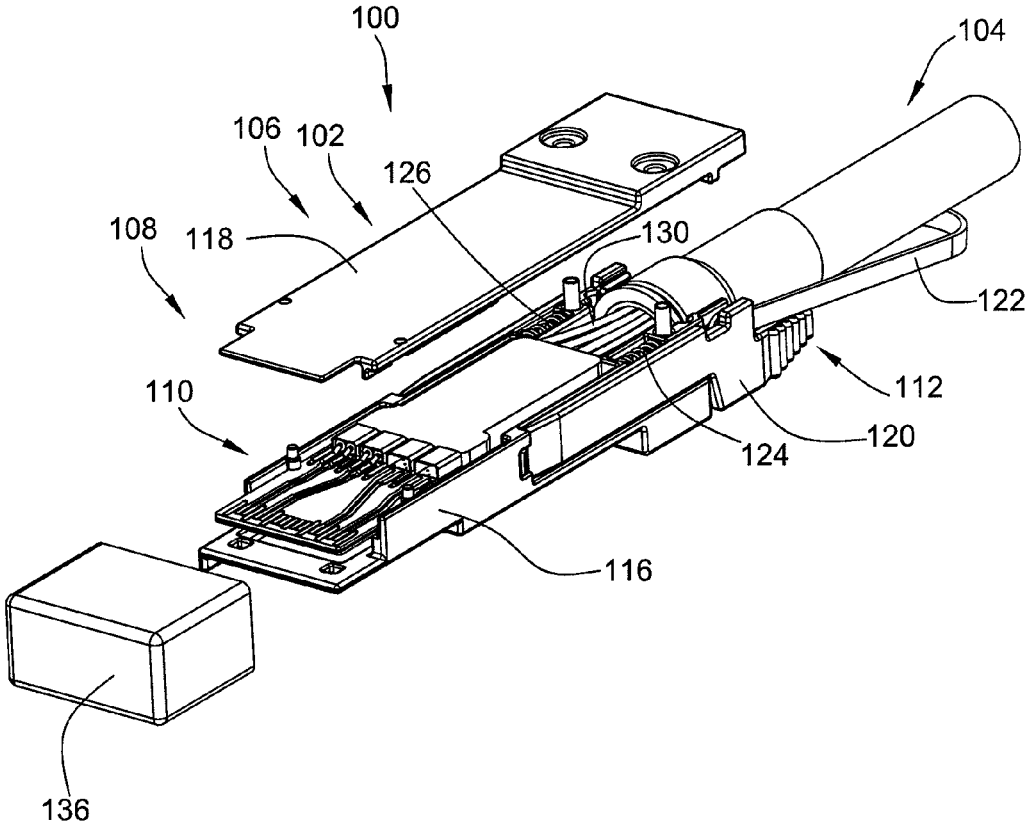
FIG. 2 is an exploded view of the cable assembly.
Figure 3:
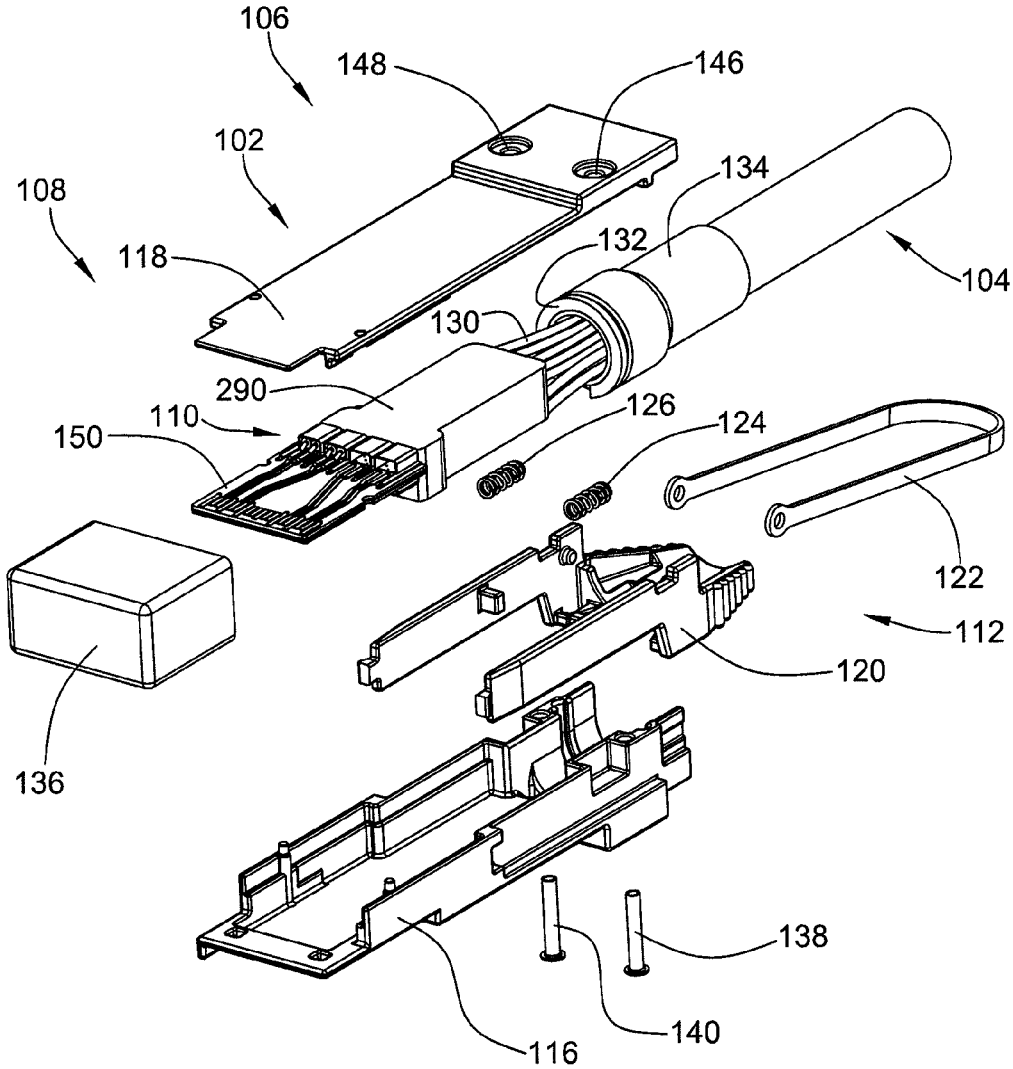
FIG. 3 is another exploded view of the cable assembly.
Figure 4:
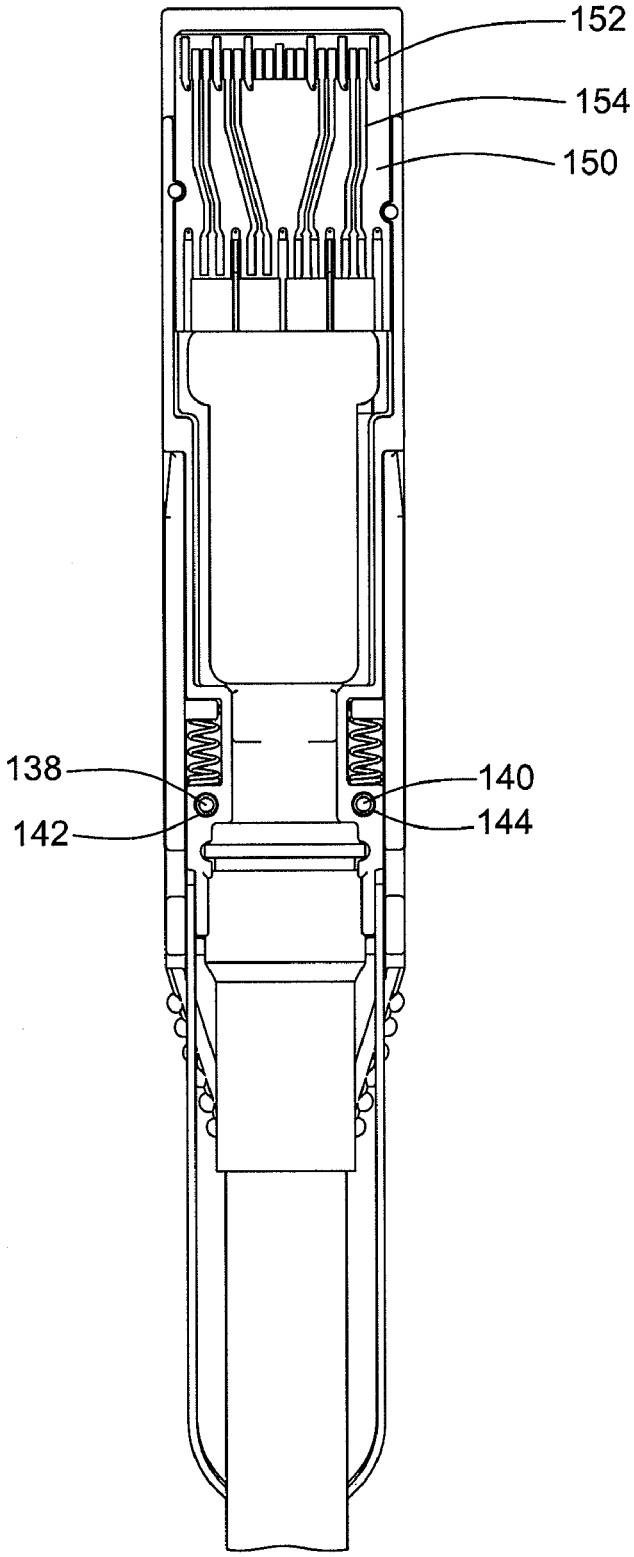
FIG. 4 is a top view of the cable assembly with the cover removed.

Referring to FIG. 1 the cable assembly 100 may include a plug connector 102, a cable 104, and a second connector 106. Referring to FIGS. 2 and 3, the plug connector 102 may include a housing 108, a board assembly 110 and a latch assembly 112. The housing 108 may include a back shell 116 and a cover 118. The latch assembly 112 may include a latch frame 120, a latch release 122 and compression springs 124, 126. The latch assembly 112 may be used to attach the plug connector 102 to a mating receptacle. The cable 104 may include wires 130, a cable exit collar 132, and a shrink sleeve 134. The cable assembly may include a dust cap 136 for use during shipment of the cable assembly. The dust cap 136 may be removed prior to connecting the plug connector to a mating receptacle. Rivets 138, 140 may be used to attach the cover 118 to the back shell 116. Referring to FIGS. 3 and 4, the rivets 138, 140 may be inserted into holes 142, 144 in the back shell and into holes 146, 148 in the cover and then the rivets 138, 140 would be deformed to prevent the removal of the rivets 138, 140. In other embodiments, screws or other fasteners may be used instead of the rivets and/or in combination with the rivets. The housing may be made of metal, such as, a zinc alloy with a copper flash underplating and a nickel plating. In another embodiment, the housing may be made of aluminum with a copper flash underplating and a nickel plating. In another embodiment, the housing may be made of a plastic with a copper flash underplating and a nickel plating.

In one embodiment, the connector 106 may be a plug connector similar to plug connector 102. In other embodiments, the plug connector 106 may be a Small Form-factor Pluggable (SFP) connector, a SFP+connector, a CXP connector, a microGIGaCN connector or other connector. In other embodiments, the cable assembly may include one, two, three, four or more plug connectors on each end and/or along the length of the cable assembly.

Figure 5:
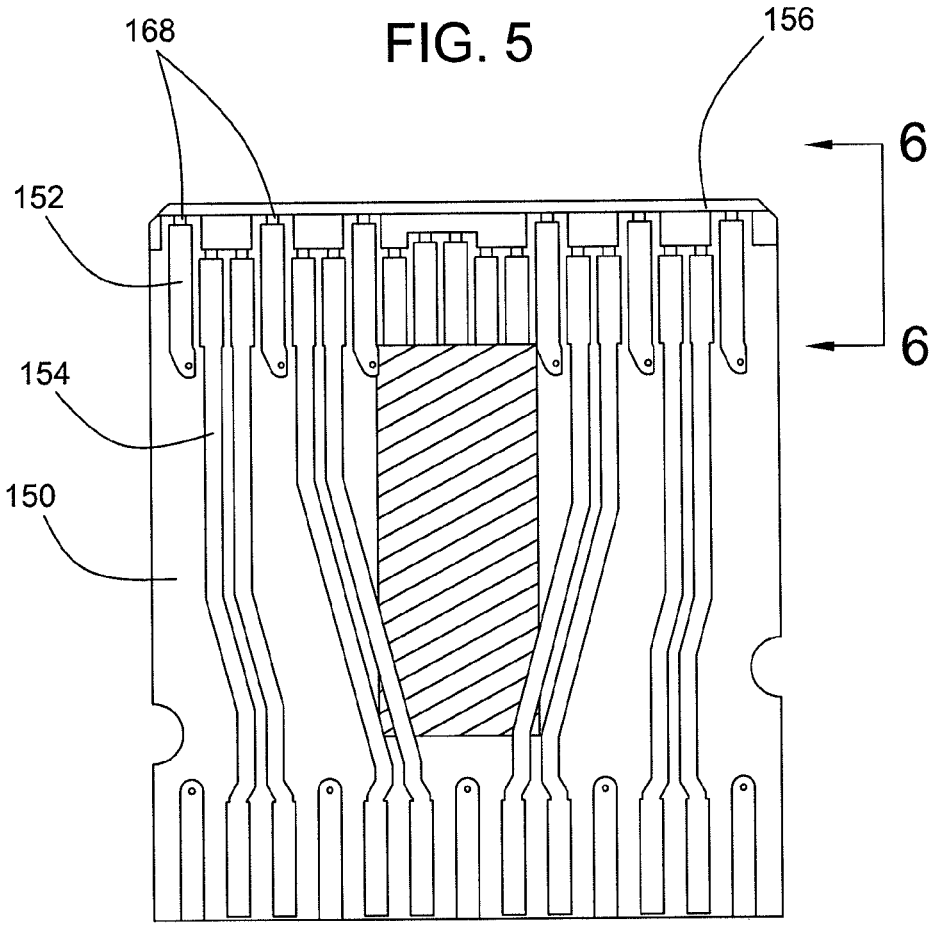
FIG. 5 is a top view of the printed circuit board.
Figure 6:
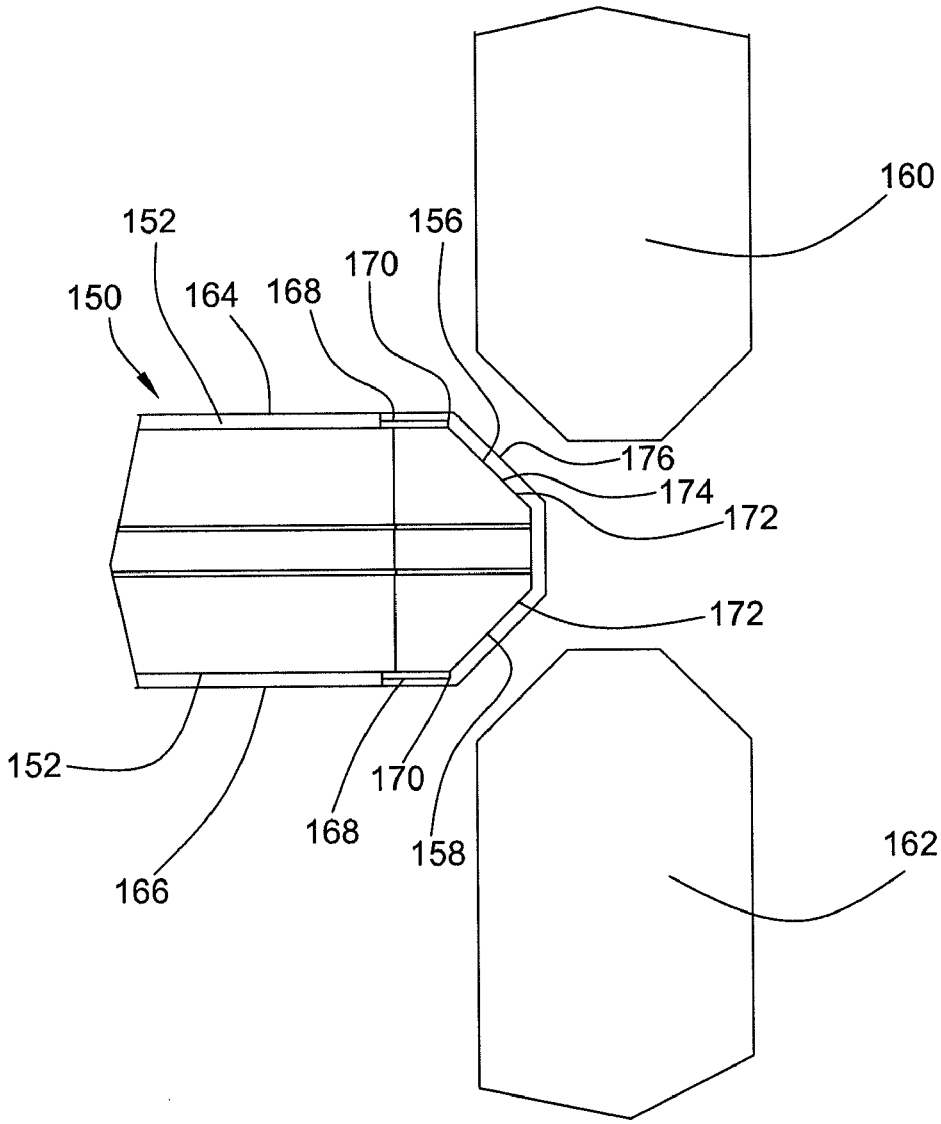
FIG. 6 is a cross-sectional view taken along line 6-6 in FIG. 5.

Referring to FIGS. 4 and 5, the board assembly 110 may include a substrate 150. The substrate 150 may be a printed circuit board. The printed circuit board 150 may include pads 152 and traces 154 on the surface of the printed circuit board. The traces transmit electrical signals across the printed circuit board. For example, the traces may transmit signals from the contacts of a mating receptacle to the wires in the cable assembly. The pads 152 and traces 154 may extend above the surface of the printed circuit board 150. Referring to FIGS. 5 and 6, the printed circuit board 150 may include chamfers 156, 158. The chamfers 156, 158 may facilitate the insertion of the printed circuit board 150 into the receptacle. For example, referring to FIG. 6, the receptacle may include contacts 160, 162. In the unengaged position, the contacts may extend below the surfaces 164, 166 of the printed circuit board. If the printed circuit board did not have the material 176 on the chamfers 156, 158 when the printed circuit board 150 is inserted into the receptacle, the contacts 160, 162 may engage the chamfers 156, 158 which may act as a ramp and allow the contacts 160, 162 to move upward.

Printed circuit boards are usually manufactured in standard panel sizes and the panel may include two or more printed circuit boards. Referring to FIGS. 5 and 6, the pads 152 and traces 154 of the printed circuit boards may be connected together through tie-bars 168. Each printed circuit board is then cut off from the panel at the tie-bars 168. The printed circuit board may then have the chamfers 156, 158 applied. Due to the cut-off process and/or the chamfering process, the exposed edges 170 of the tie bars 168 and the fiberglass 172 of the printed circuit board may be found on the cut-off edge of the printed circuit board. If the printed circuit board edge is mated with a contact on a receptacle, a fiber from the fiberglass may be dragged into the contact area between the printed circuit board pad 152 and the contact. Also, the sharp tie-bar edge 170 can skive or remove plating from the contact 160, 162 during the insertion process.

In order to prevent a loose fiber from entering the contact area and/or to prevent the rough edge 170 from removing the plating on the mating contact, the edge 174 of the printed circuit board may be enclosed with a material 176. The material 176 may be an overmolded plastic or a coating of material. The coating may be a conformal coating, a paint, an acrylic, a silicone, a polyurethane, an ultra-violet cured coating, a water based coating, a fluoroacrylic, a physical vapor deposition coating (such as, by thermal evaporation or by sputtering), a chemical vapor decomposition coating, a urethane acrylate (such as, Dymax 984-LVUF by Dymax Corporation, Torrington, Conn., USA), a polyurethane (such as, Humiseal 1A33 by Chase Corporation, Bridgewater, Mass., USA), a urethane (such as, Humiseal 1A20 by Chase Corporation, Bridgewater, Mass., USA), and a urethane (such as, Hysol PC 18M by Henkel AG, Dusseldorf, Germany). The material 176 may encapsulate the fibers on the edge of the printed circuit board in order to prevent fibers from separating from the edge. In addition, the material 176 may provide a transition between the printed circuit board edge 174 and the pads 152. The material 176 may be less abrasive than the edge of the printed circuit board. Embodiments with the overmolded material are shown in FIGS. 34-38.

Figure 7:
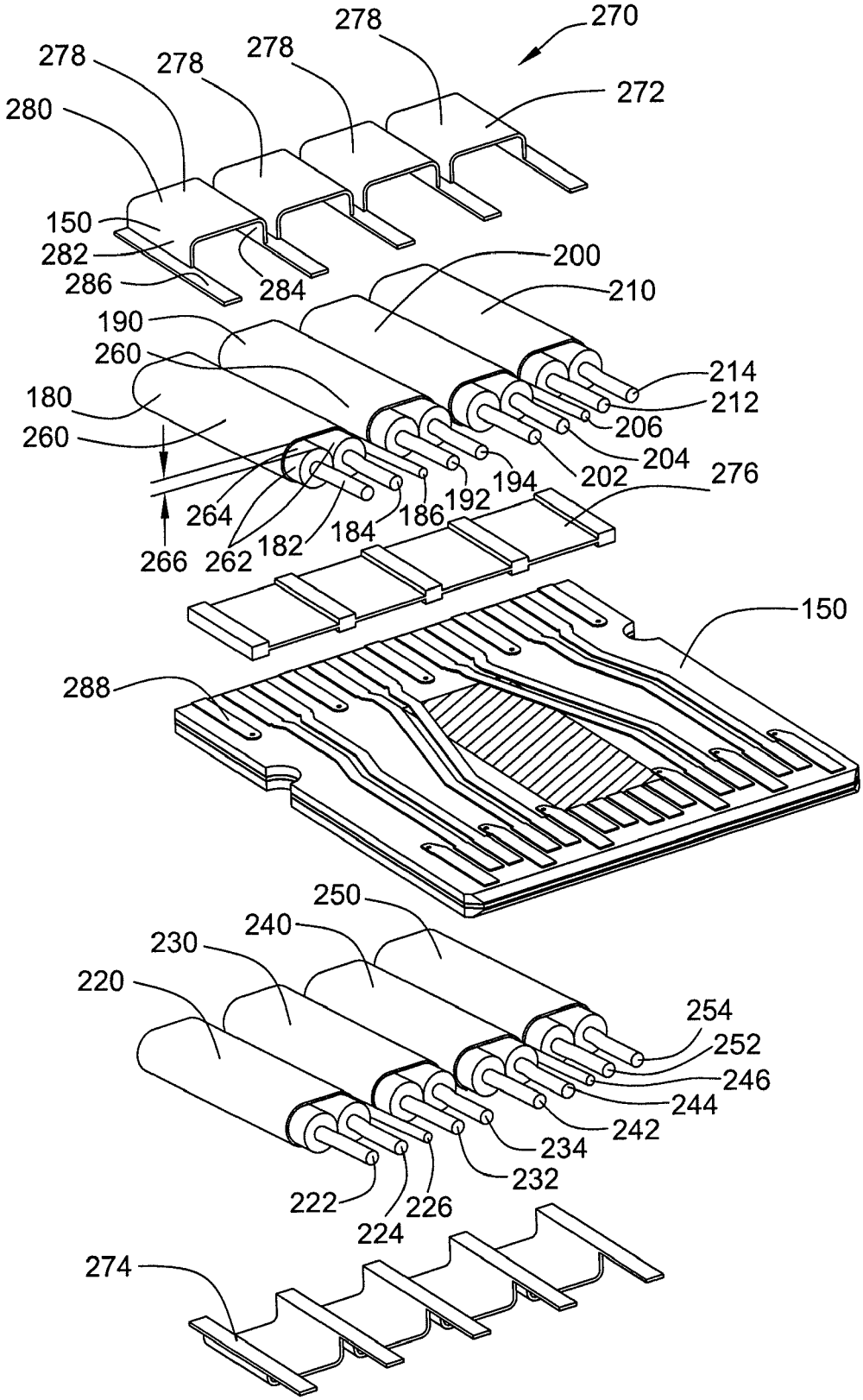
FIG. 7 is an exploded view of the cable assembly.

Referring to FIG. 7, the cable assembly 100 may include several pairs of wires. For example, the cable may include a first wire pair 180 with wires 182, 184, a second wire pair 190 with wires 192, 194, a third wire pair 200 with wires 202, 204, a fourth wire pair 210 with wires 212, 214, a fifth wire pair 220 with wires 222, 224, a sixth wire pair 230 with wires 232, 234, a seventh wire pair 240 with wires 242, 244, and an eighth wire pair 250 with wires 252, 254. In other embodiments, the cable assembly may include one to thirty-two or more pairs of wires. The cable assembly may include wire pairs in increments of two. The cable assembly 100 may include drain wires 186, 206, 226, 246.

Cross talk between differential wire pairs is a measure of the amount of voltage that can couple from one transmission differential wire pair to another wire pair. Cross talk increases when the differential wire pairs are placed in close proximity to each other. In addition, the wires may create or be subject to electromagnetic interference ("EMI").

Figure 8:
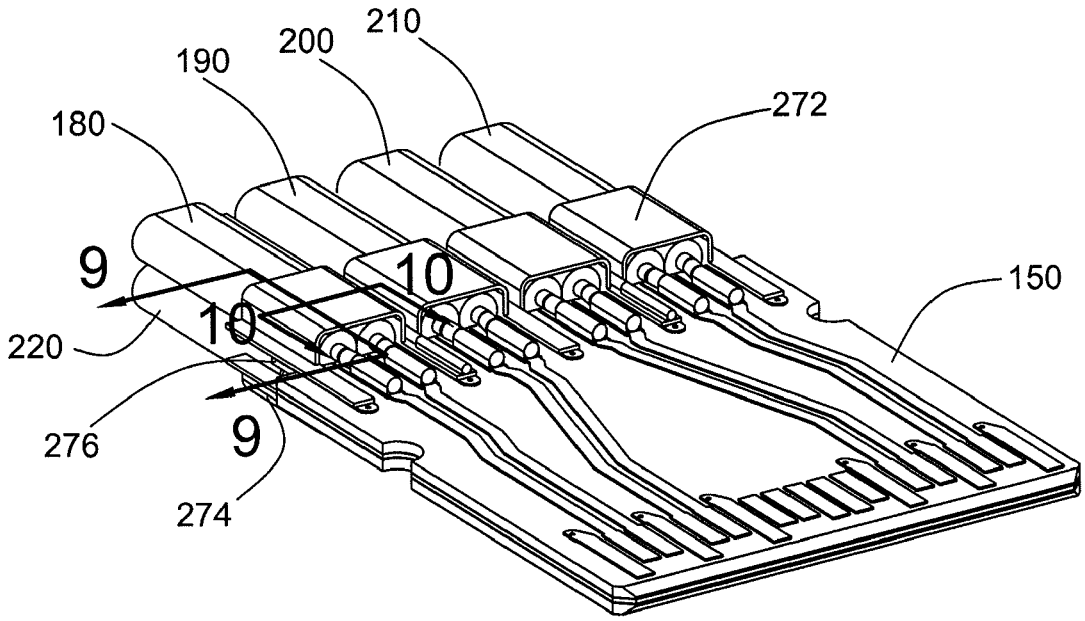
FIG. 8 is a perspective view of the cable assembly.

Referring to FIG. 7, cross talk and/or EMI between wire pairs 180, 190, 200, 210, 220, 230, 240, 250 that are inside the cable is minimal because each wire pair is wrapped by a conductive shield 260. To solder or terminate the wires 182, 184 to the printed circuit board 150, the cable shield 260 and the insulation 262 must be removed and the wires 182, 184 must be exposed. The areas 264 that are stripped of the cable shield 260 may cause or be subject to cross talk and/or EMI. The areas 264 may have a length 266. The length 266 may have a first range from about 0 mm to about 10 mm, a second range from about 0 mm to about 5 mm, and a third range from about 0 mm to about 4 mm, In one embodiment, the length 266 may be 3.8 mm. FIG. 8 shows the wire pairs 180, 190, 200, 210 terminated on one side of the printed circuit board 150. The other side of the printed circuit board 150 will have similar terminations.

Figure 22:
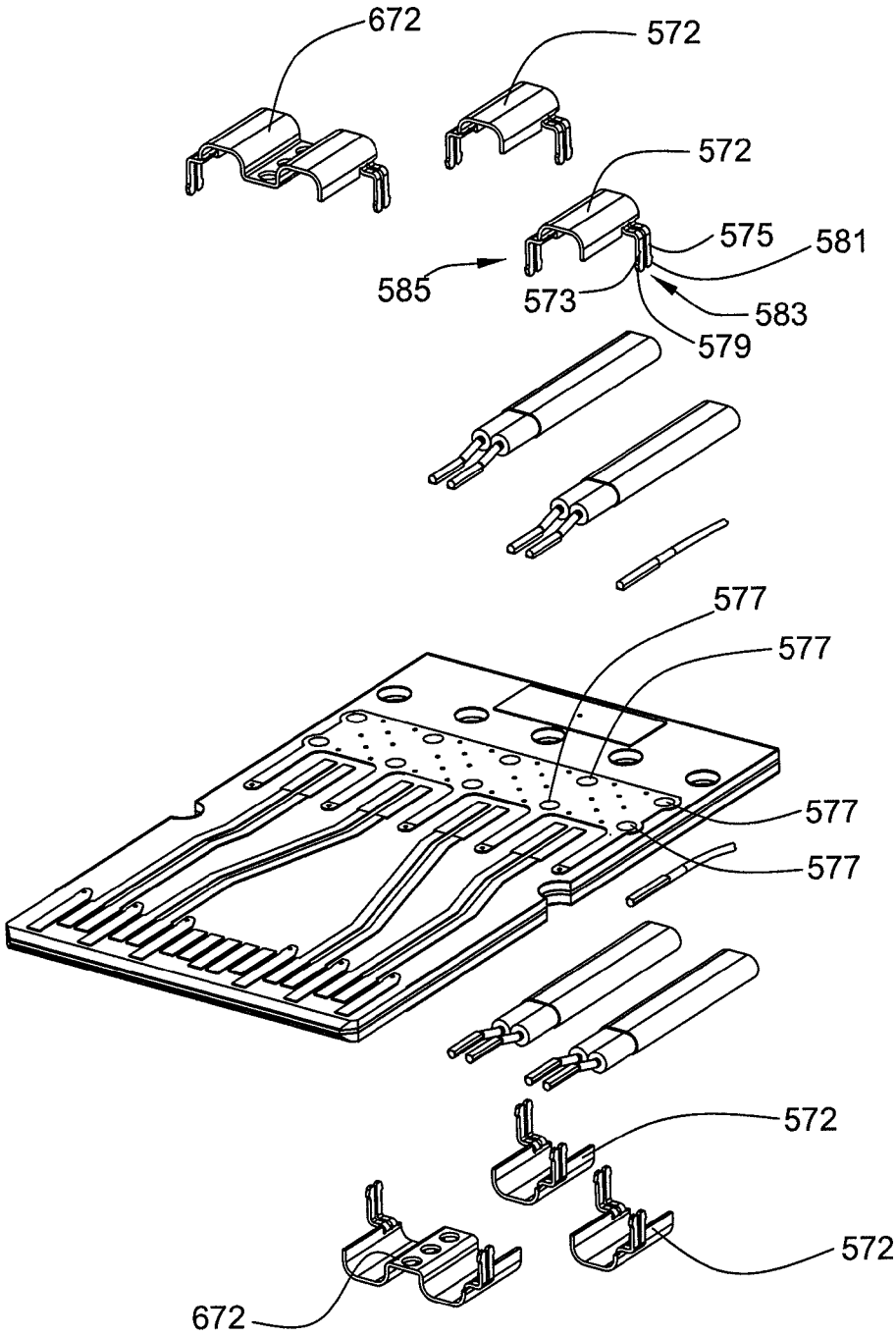
FIG. 22 is an exploded view of the cable assembly in FIG. 21.
Figure 33:
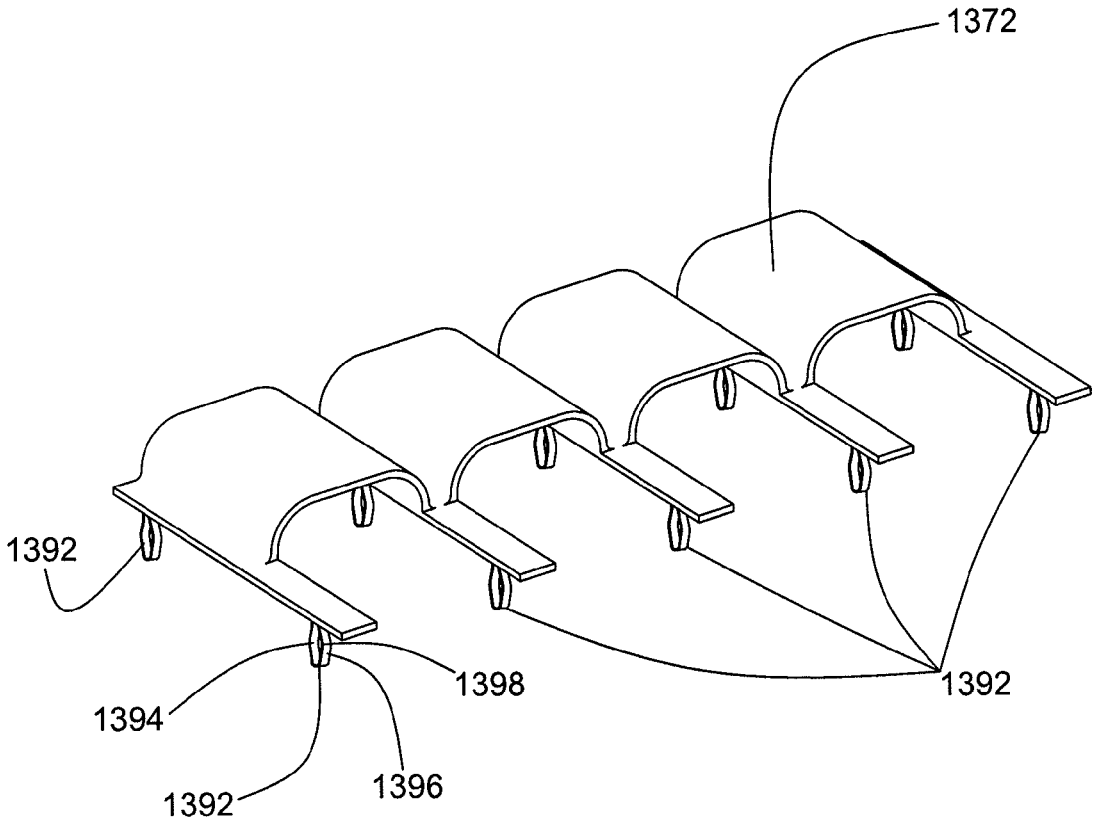
FIG. 33 is a perspective view of another embodiment of a top shield.

In order to reduce the crosstalk and/or EMI in the areas 264 where the cable shield 260 is removed, a shielding assembly 270 may be used. In one embodiment, the shielding assembly may include a top shield 272, a bottom shield 274, and an intermediate shield 276. The top shield 272 may have a shielding portion 278 for each pair of wires. In this embodiment, the top shield 272 may have four shielding portions 278. The shielding portions 278 may be connected. In other embodiments, the shielding portions may be separate components. The shielding portion 278 may include a top portion 280, a first side portion 282 and a second side portion 284. The top shield 272 may include one or more grounding legs 286. The grounding leg 286 may be connected to the ground trace 288 on the printed circuit board 150. The grounding leg 286 may be connected by soldering, conductive epoxy, or by a mechanical attachment, such as, a two lead attachment or a compliant pin. An example of a two lead attachment is shown in FIG. 22. An example of a compliant pin attachment is shown in FIG. 33.

Figure 9:
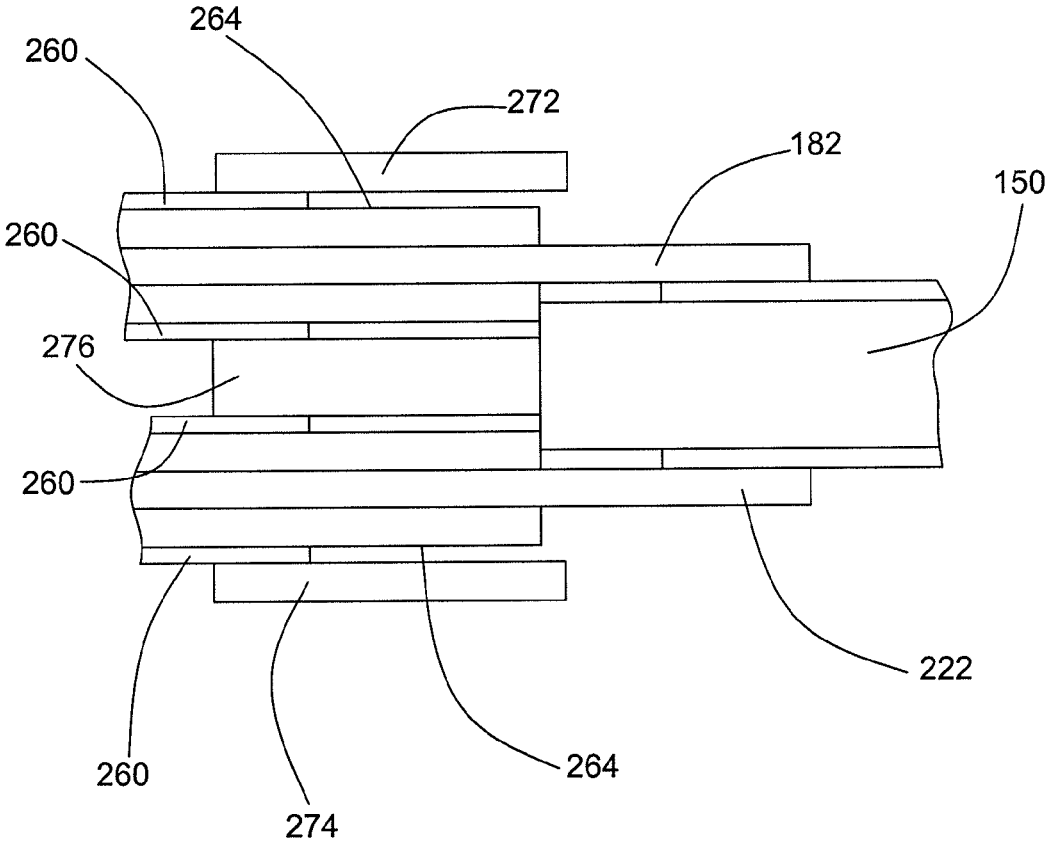
FIG. 9 is a cross-sectional view taken along line 9-9 of FIG. 8.
Figure 10:
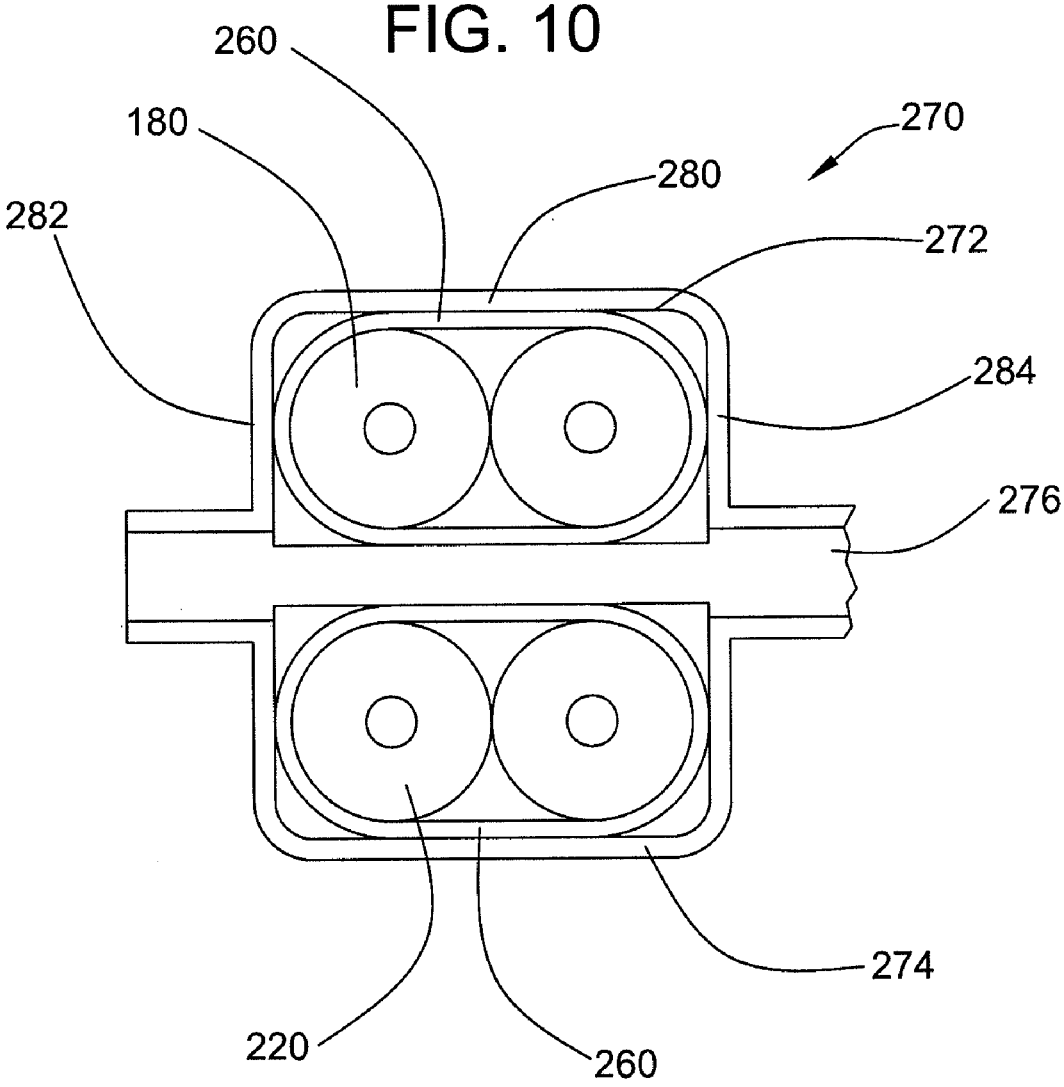
FIG. 10 is a cross-sectional view taken along line 10-10 of FIG. 8.
Figure 11:
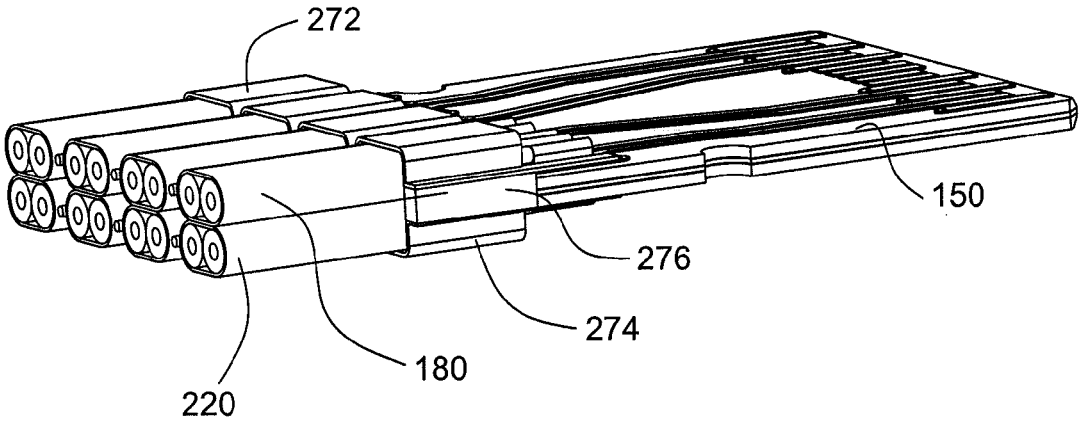
FIG. 11 is a rear perspective view of the cable assembly.

Referring to FIG. 9, the top shield 272, the bottom shield 274, and the intermediate shield 276 provide shielding for the areas 264 without the cable shielding 260. Referring to FIG. 10, the top portion 280, the first side portion 282 and the second side portion 284 provide shielding for the top, and sides of the first wire pair 180. The intermediate shield 276 may provide shielding for the bottom of the first wire pair 180. Thus, the shielding assembly 270 may provide 360 degrees of shielding for the first wire pair 180. Similarly, the shielding assembly 270 may provide shielding for the other wire pairs, such as, the second wire pair 190, the third wire pair 200, and the fourth wire pair 210.

Referring to FIG. 10, the bottom shield 274 may be similar to or the same as the top shield 272. For example, the bottom shield 274 may provide shielding for the bottom and sides of the fifth wire pair 220. The intermediate shield 276 may provide shielding for the top of the fifth wire pair 220. The shielding assembly 270 may provide shielding for the other wire pairs, such as, the fifth wire pair 220, the sixth wire pair 230, the seventh wire pair 240 and the eighth wire pair 250.

Figure 39:
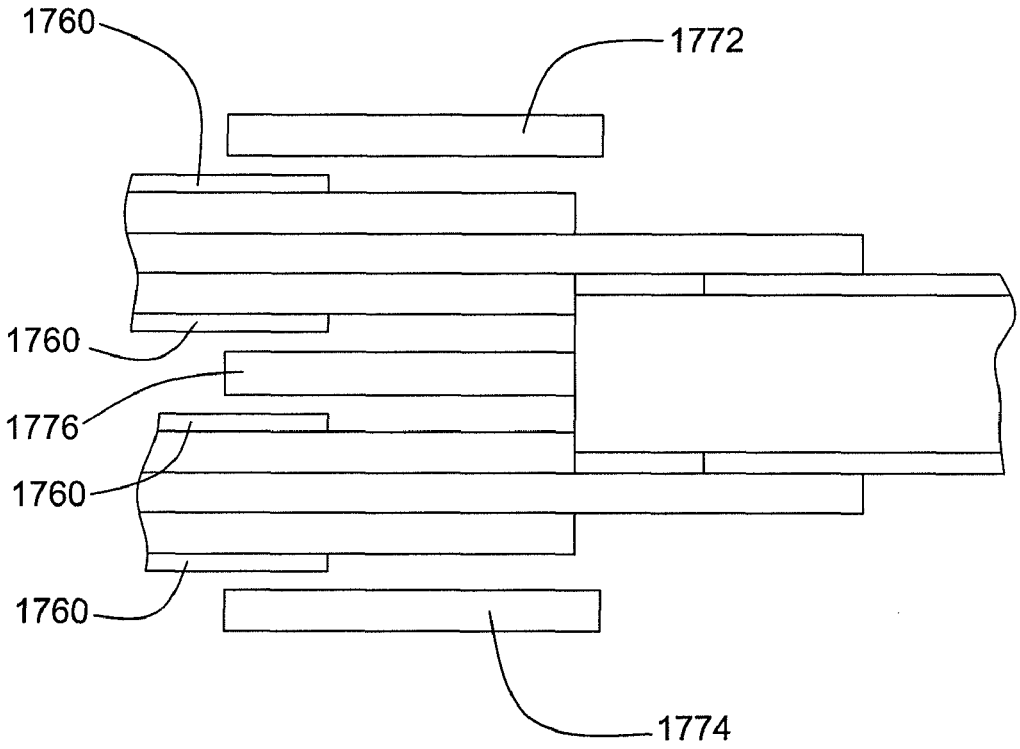
FIG. 39 is a cross-sectional view similar to FIG. 9 of another embodiment.
Figure 40:
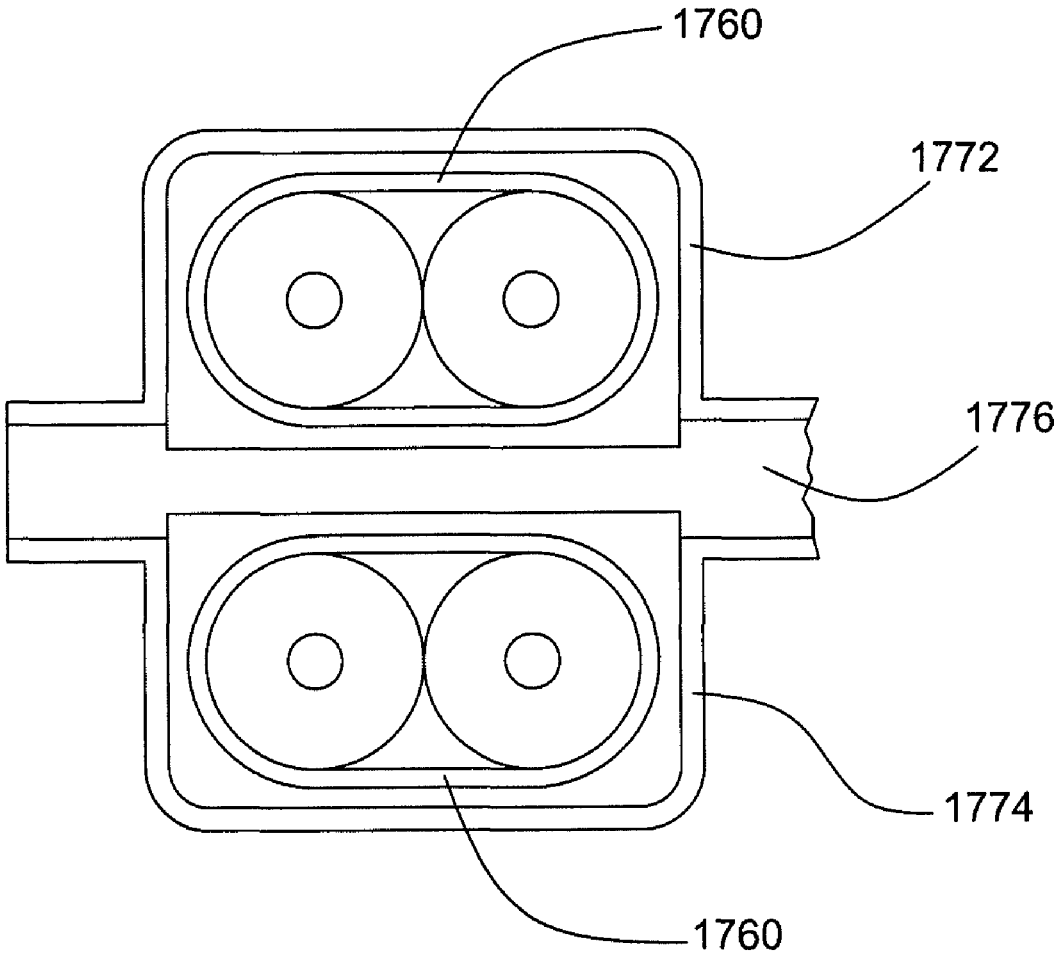
FIG. 40 is a cross-sectional view similar to FIG. 10 of another embodiment.

Referring to FIGS. 9 and 10, the cable shielding 260 may contact the top shield 272, the bottom shield 274 and the intermediate shield 276 in order to maintain the ground path. In another embodiment shown in FIGS. 39 and 40, the cable shielding 1760 may not contact the top shield 1772, the bottom shield 1774, and the intermediate shield 1776. The cable shielding may contact the drain wires within the cable in order to maintain the ground path. In another embodiment, the cable shielding may contact the top shield and the bottom shield, but may not contact the intermediate shield. In another embodiment, the cable shielding may contact the intermediate shield, but may not contact the top shield and bottom shield. Other embodiments may have different combinations of contact between the cable shield and the shielding assembly.

The wires may be attached to the printed circuit board 150 in the following manner. The wire pairs may be stripped of the conductive shield 260 and the insulation 262. The wire pairs may be placed in a fixture to hold the wires in position. Referring to FIG. 7, the intermediate shield 276 and printed circuit board 150 may be positioned between the wires. The top shield 272, the bottom shield 274, and the intermediate shield 276 may be attached to the printed circuit board 150. The shields 272, 274, 276 may be attached by soldering, conductive epoxy, or mechanical attachment as noted herein. The wires, such as wires 182, 184, may be soldered to the printed circuit board 150. If the shields are attached by soldering, the soldering of the shields may occur at the same time as the soldering of the wires. In another embodiment, the soldering of the shields may occur at a different time than the soldering of the wires. Referring to FIG. 3, the overmold material 290 is molded over the wires. The overmold material may be an insulative plastic material.

Figure 12:
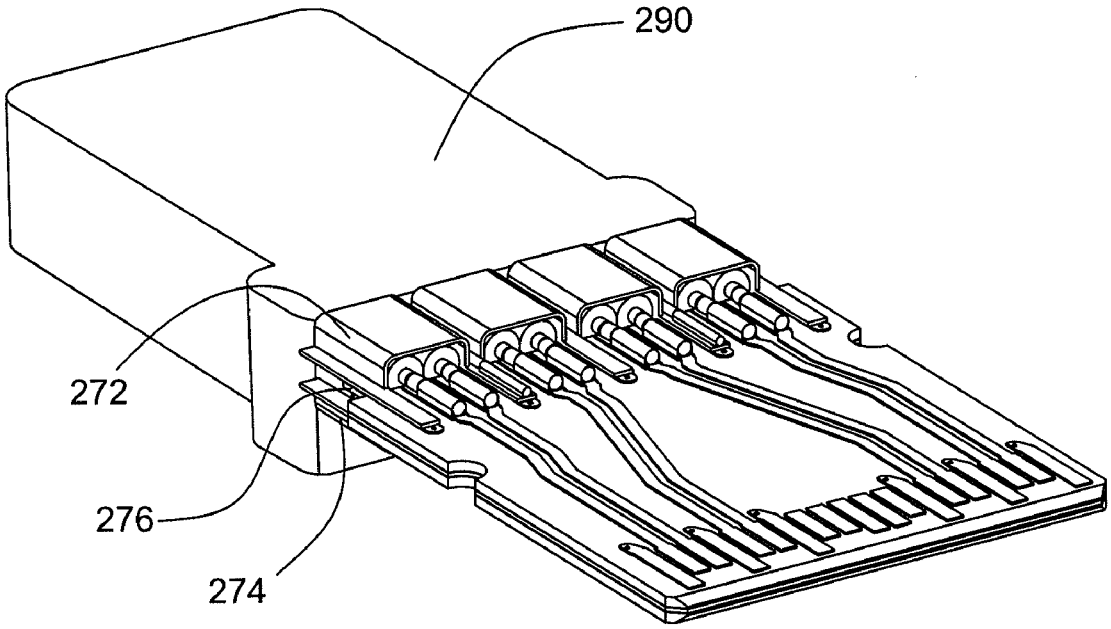
FIG. 12 is a perspective view of the cable assembly with the overmold located near the rear of the shields.
Figure 13:
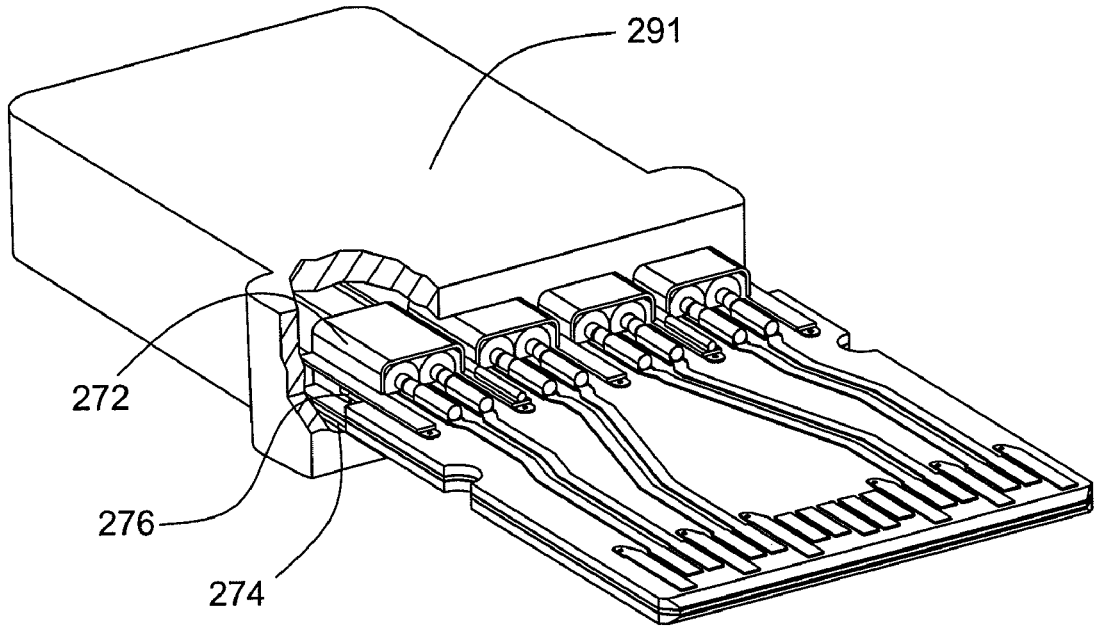
FIG. 13 is a perspective view of another embodiment of the cable assembly with the overmold located partially over the shields.
Figure 14:
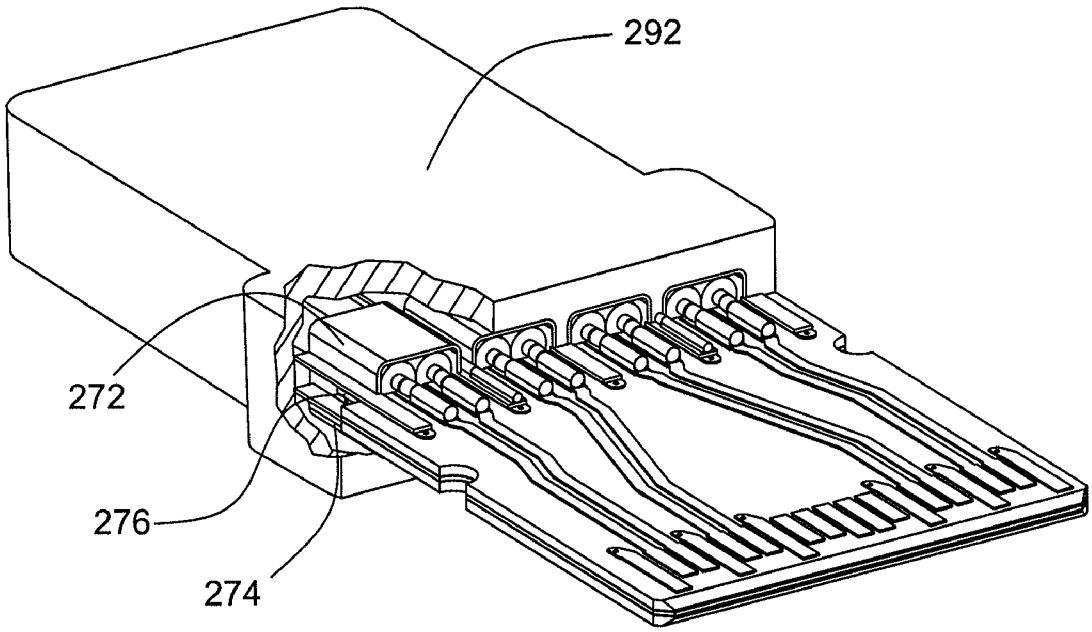
FIG. 14 is a perspective view of another embodiment of the cable assembly with the overmold located completely over the shields.

The overmold material may be located in different positions with respect to the shields. In one embodiment as shown in FIG. 12, the overmold material 290 is located near the rear of the shields 272, 274, 276. In another embodiment as shown in FIG. 13, the overmold material 291 is located partially over the shields 272, 274, 276. In another embodiment as shown in FIG. 14, the overmold material 292 is located completely over the shields 272, 274, 276. In another embodiment, the overmold material may be located over the shields and over the solder attachments for the wires.

In another embodiment of the assembly process, the wire pairs may be stripped of the conductive shield 260 and the insulation 262. The wire pairs may be placed in a fixture to hold the wires in position. The overmold material 290 is molded over the wires while the wires are in the fixture. The wires are then removed from the fixture. Referring to FIG. 7, the intermediate shield 276 and printed circuit board 150 may be positioned between the wires. The top shield 272, the bottom shield 274, and the intermediate shield 276 may be attached to the printed circuit board 150. The shields 272, 274, 276 may be attached by soldering or mechanical attachment as noted herein. The wires, such as wires 182, 184, may be soldered to the printed circuit board 150. If the shields are attached by soldering, the soldering of the shields may occur at the same time as the soldering of the wires. In another embodiment, the soldering of the shields may occur at a different time than the soldering of the wires.

Figure 15:
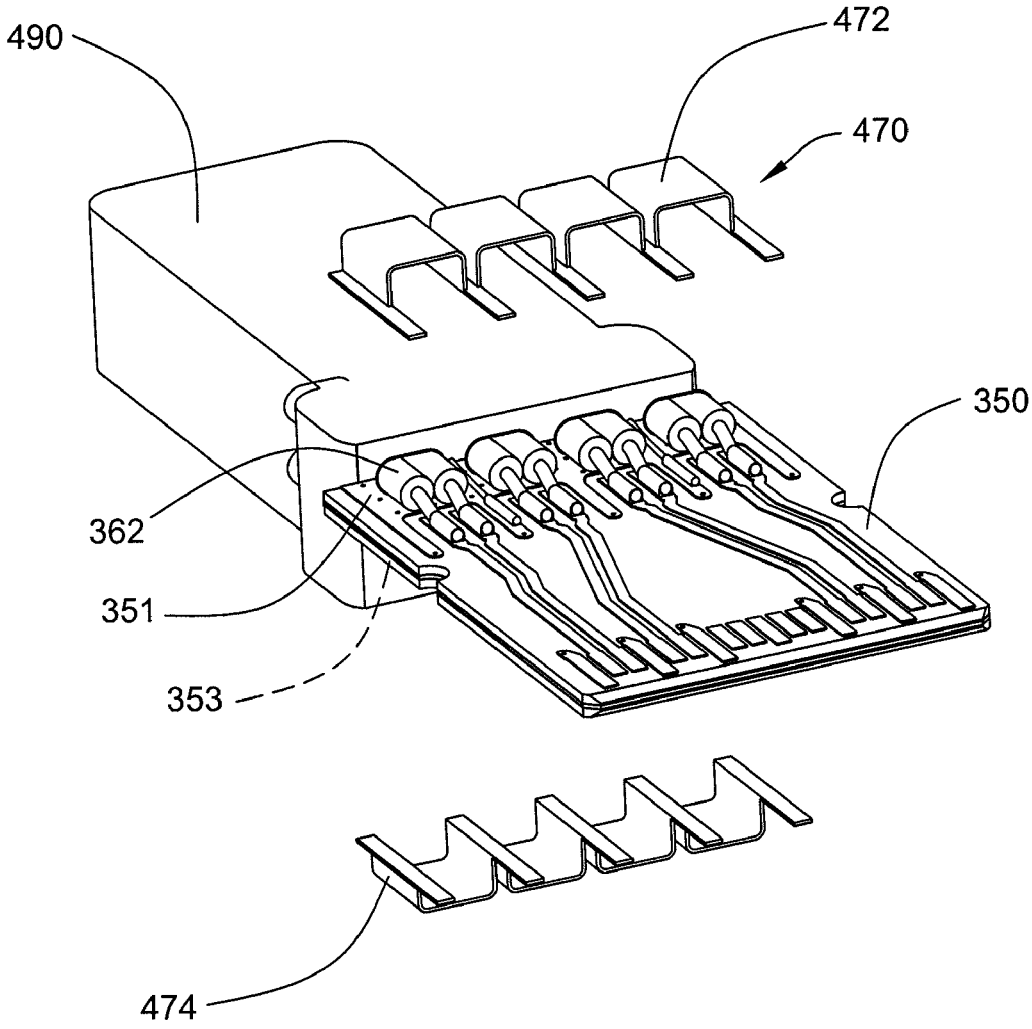
FIG. 15 is an exploded view of another embodiment of a cable assembly.
Figure 16:
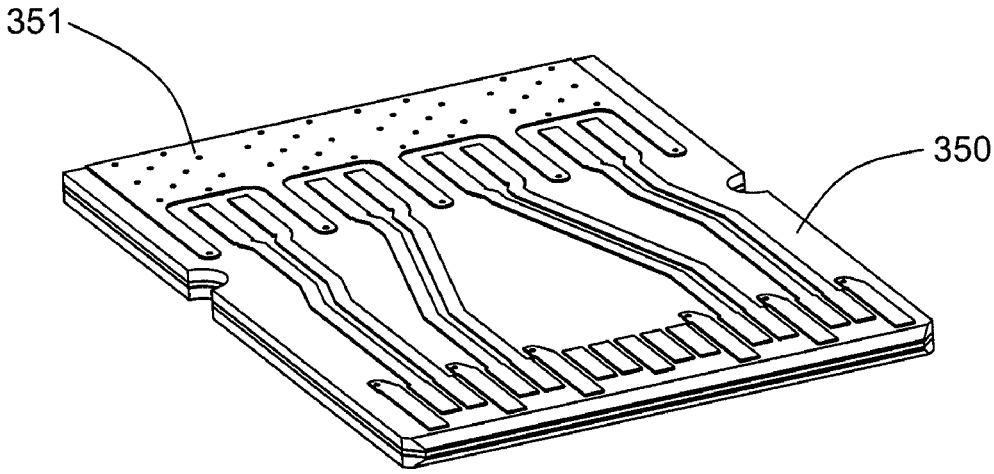
FIG. 16 is a perspective view of the printed circuit board in FIG. 15.

Referring to FIG. 15, another embodiment of a shielding assembly is shown. The shield assembly 470 may include a top shield 472 and a bottom shield 474. In one embodiment, the top shield 472 and bottom shield 474 may be similar to the top shield 272 and bottom shield 274 in FIG. 7. The printed circuit board 350 may be similar to the printed circuit board 150 in FIG. 7 except that the printed circuit board 350 may have one or more ground planes 351, 353 as shown in FIGS. 15 and 16. The ground plane 351 may be located on the upper surface of the printed circuit board. The ground plane 353 may be located on the lower surface of the printed circuit board. Referring to FIG. 15, the insulation 362 on the wires is positioned on the printed circuit board 350. For example, the insulation 362 may be positioned over the ground plane 351.

Figure 17:
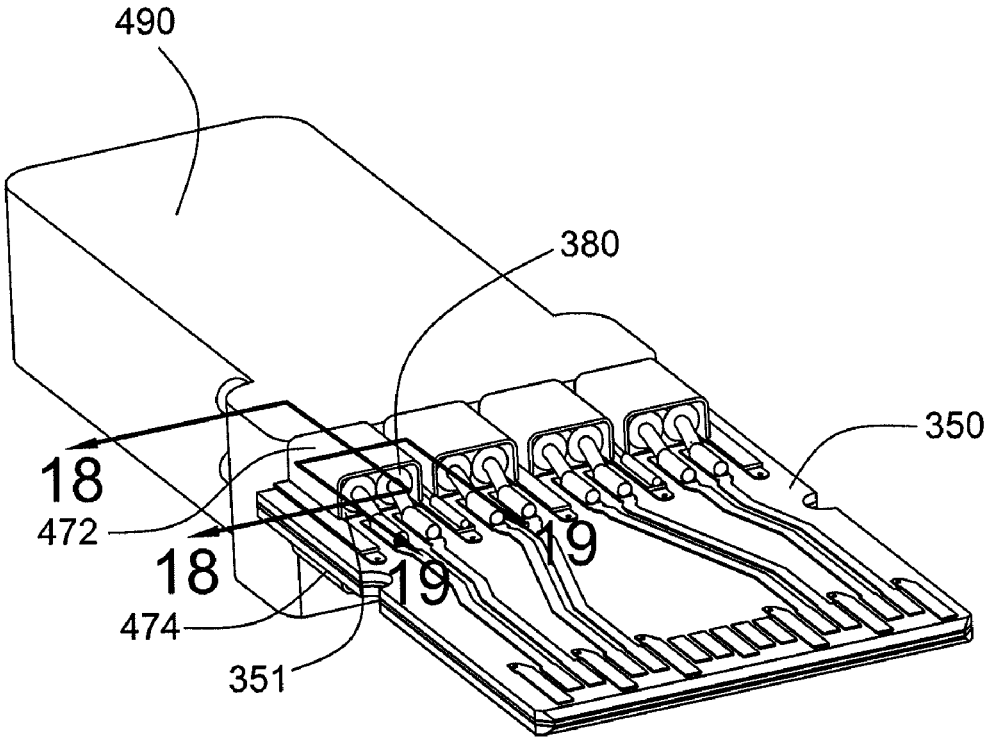
FIG. 17 is a perspective view of the cable assembly in FIG. 15.
Figure 18:
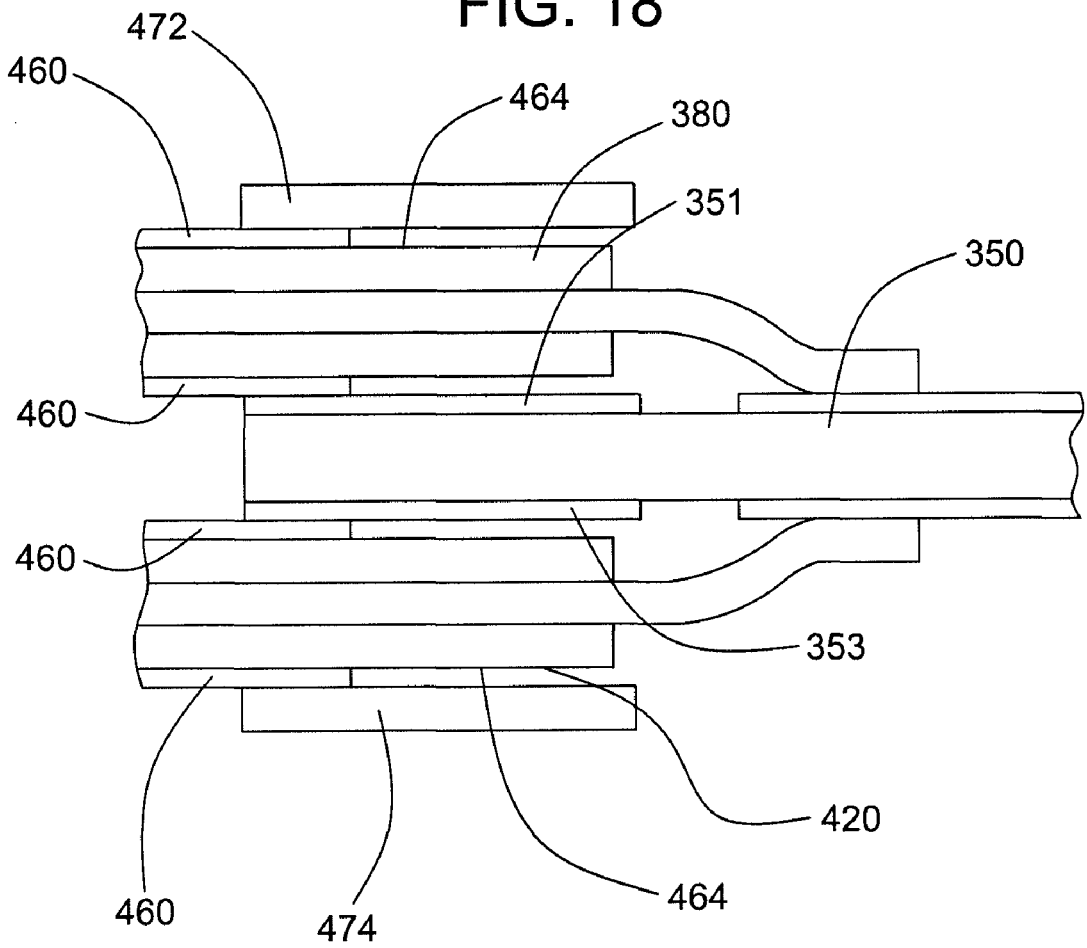
FIG. 18 is a cross-sectional view taken along line 18-18 of FIG. 17.
Figure 19:
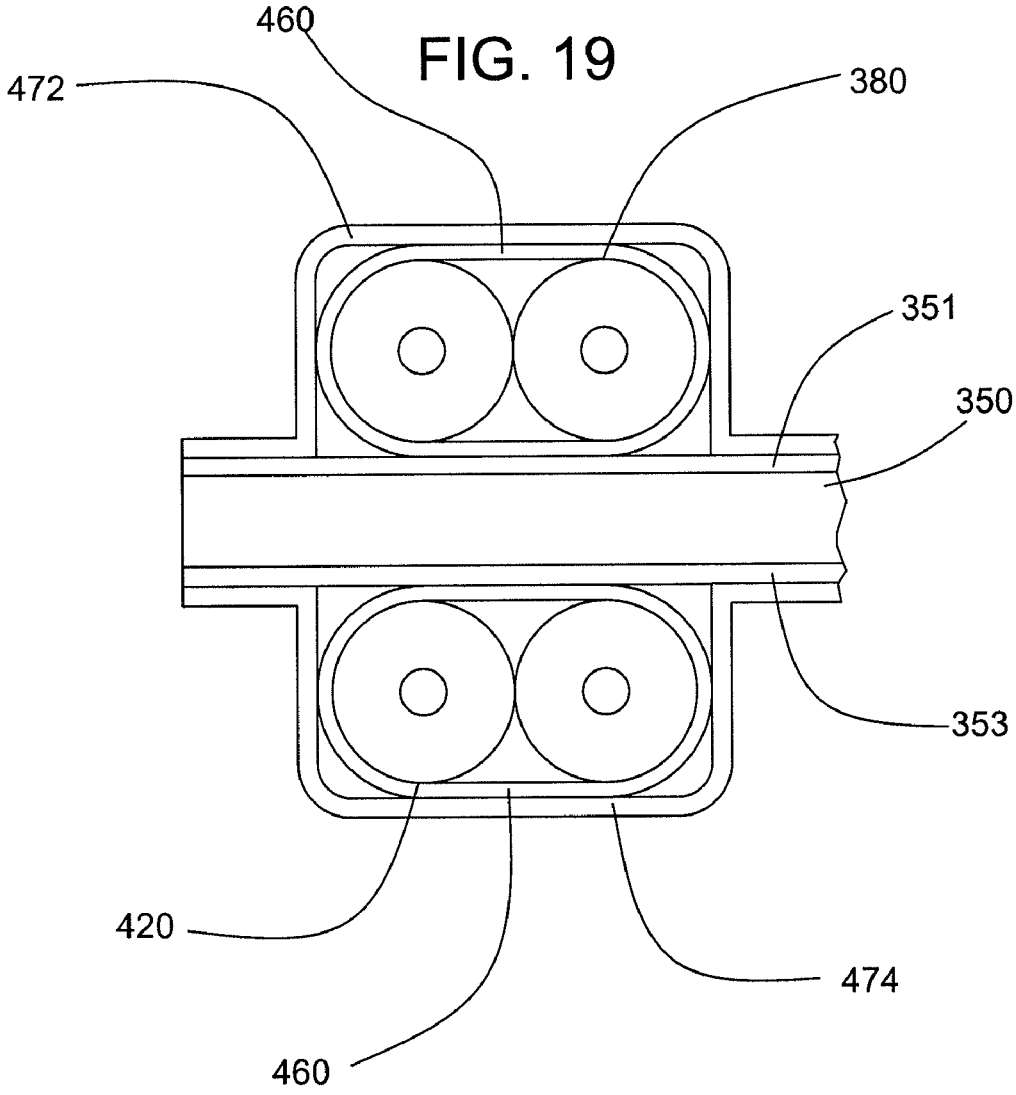
FIG. 19 is a cross-sectional view taken along line 19-19 of FIG. 17.

Referring to FIGS. 17-19, the top shield 472 and the ground plane 351 may provide 360 degrees of shielding for the area 464 of the first wire pair 380 without the cable shield 460. The top shield 472 and ground plane 351 may also provide 360 degrees of shielding for the other wire pairs on the top surface of the printed circuit board. Similarly, the bottom shield 474 and the ground plane 353 may provide 360 degrees of shielding for the area 464 of the wire pair 420 without the cable shield 460. The bottom shield 474 and the ground plane 353 may also provide 360 degrees of shielding for the other wire pairs located on the bottom of the printed circuit board 350.

Figure 41:
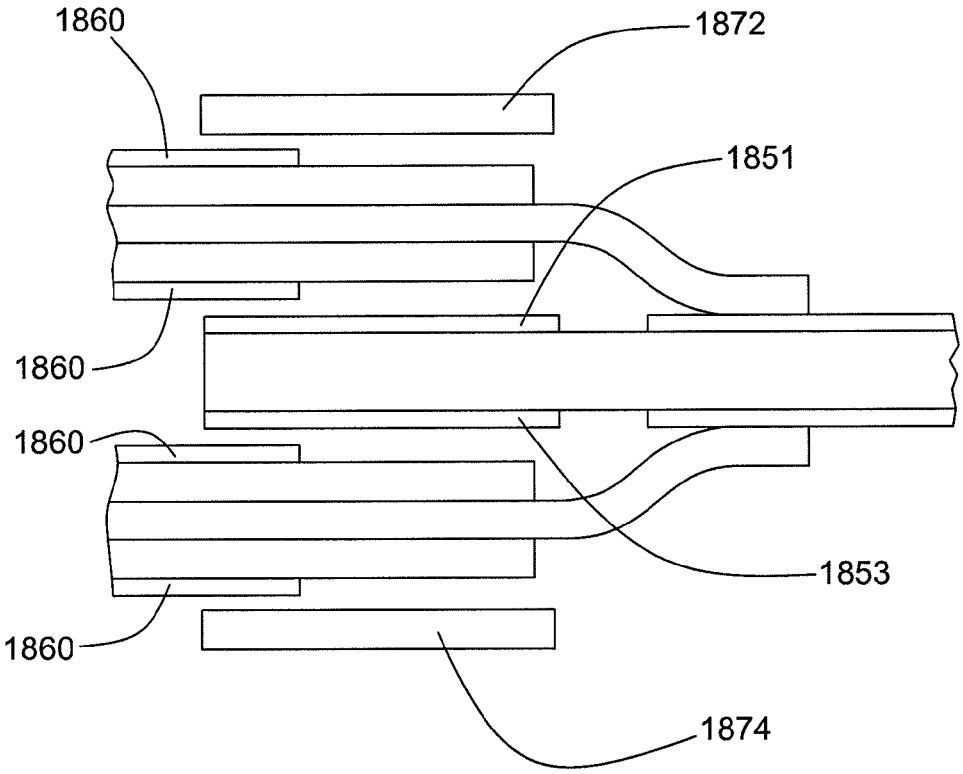
FIG. 41 is a cross-sectional view similar to FIG. 18 of another embodiment.
Figure 42:
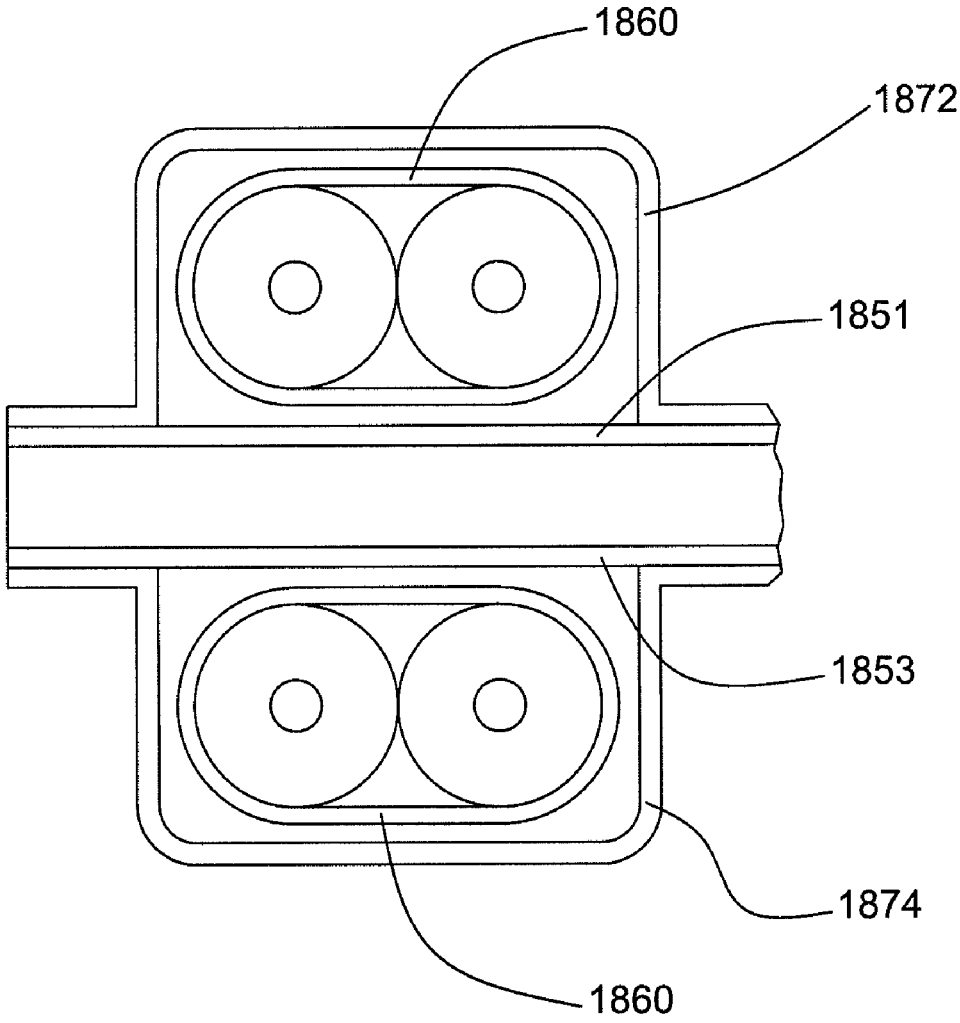
FIG. 42 is a cross-sectional view similar to FIG. 19 of another embodiment.

Referring to FIGS. 18 and 19, the cable shield 460 for the first wire pair 380 may contact the top shield 472 and the ground plane 351 in order to maintain the ground path. The cable shield 460 for the other wire pairs on the top of the printed circuit board may similarly contact the top shield 472 and ground plane 351. The cable shield 460 for the wire pair 420 may contact the bottom shield 474 and the ground plane 353 in order to maintain the ground path. The cable shield 460 for the other wire pairs on the bottom of the printed circuit board may similarly contact the bottom shield 474 and ground plane 353. In another embodiment shown in FIGS. 41 and 42, the cable shielding 1860 may not contact the first ground plane 1851, the second ground plane 1853, the top shield 1872, and the bottom shield 1874. The cable shielding may contact the drain wires within the cable in order to maintain the ground path. In another embodiment, the cable shielding may contact the first ground plane and the second ground plane, but may not contact the top shield and bottom shield. In another embodiment, the cable shielding may contact the top shield and the bottom shield, but may not contact the first ground plane and the second ground plane. Other embodiments may have different combinations of contact between the cable shield and the shielding assembly.

Referring to FIG. 17, the wires may be attached to the printed circuit board using the assembly processes as noted herein with respect to the embodiment shown in FIG. 7 except that the embodiment in FIG. 17 does not require the assembly of a separate intermediate shield.

Figure 20:
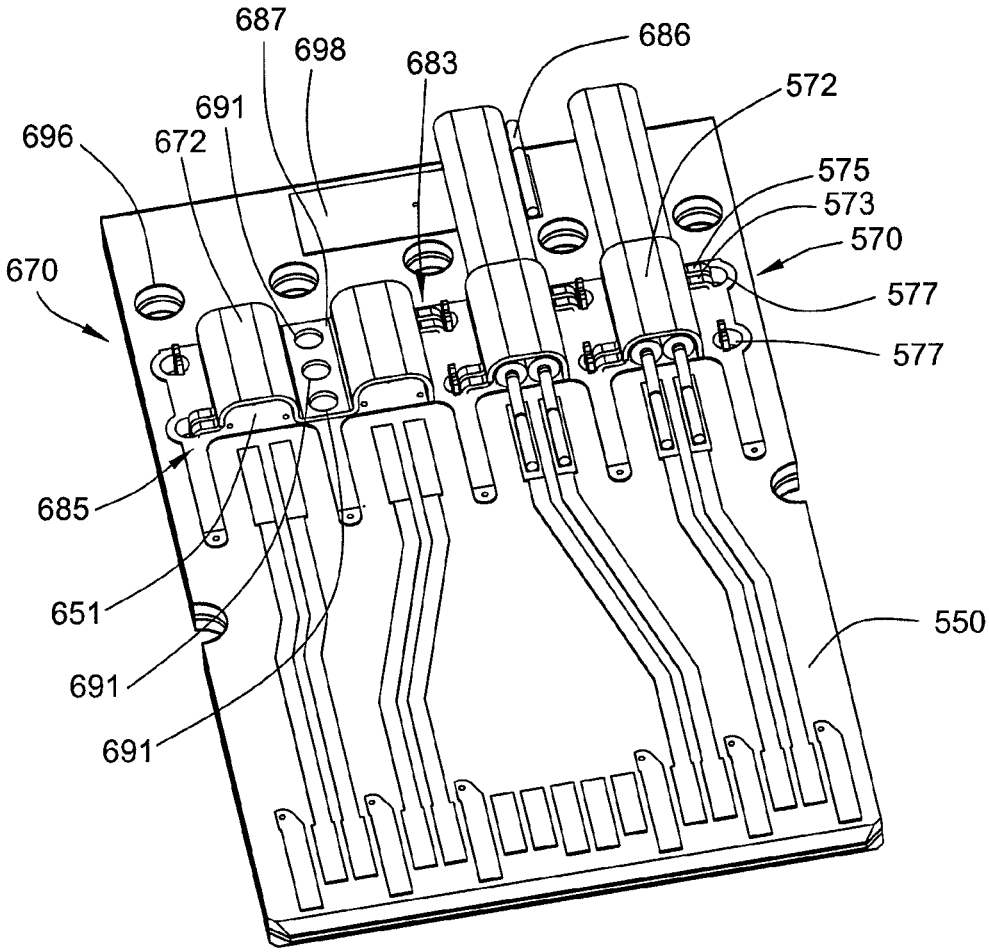
FIG. 20 is a perspective view of another embodiment of the cable assembly.
Figure 21:
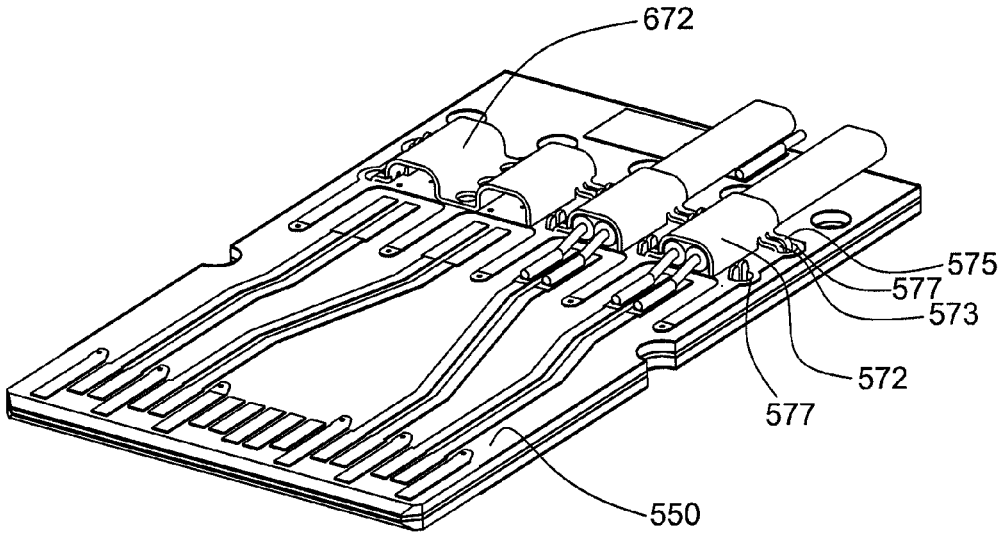
FIG. 21 is a perspective view of the cable assembly in FIG. 20.

Referring to FIG. 20, two embodiments of shield assemblies 570, 670 are shown. The shield assembly 570 may include a top shield 572. The top shield 572 may be similar to top shield 472 except that top shield 572 may be used with one pair of wires and the top shield 572 may have two leads 573, 575 for attachment to the printed circuit board 550. The printed circuit board 550 may include an opening 577. The opening 577 may be a plated opening which may be connected to the ground planes of the printed circuit board. The opening 577 may receive the two leads 573, 575. Referring to FIG. 22, the two leads 573, 575 may include hook portions 579, 581. The hook portions 579, 581 may be wider than the opening 577. When the leads 573, 575 are inserted into the opening 577, the leads may deflect inward and allow the hook portions 579, 581 to enter the opening. When the hook portions 579, 581 exit the opening 577, the leads 573, 575 and hook portions 579, 581 extend outward. The hook portions 579, 581 may engage the rim of the opening 577 and prevent the top shield 572 from being removed. In another embodiment, the leads may not include the hook portions and may be held in the opening by the outward force of the leads on the opening and/or by a friction fit.

The top shield 572 may have two sets of leads 583, 585 and the two sets of leads 583, 585 may be positioned diagonally from each other. The diagonal positioning allows the shield 572 to be used in a bottom location and allows the leads to be inserted into openings 577 which are being used by the upper and lower shields in adjacent locations.

The top shield 572 may be used with one wire pair or multiple top shields 572 may be used with multiple wire pairs. For example, eight top shields 572 may be used with eight wire pairs. The top shields 572 may be used in conjunction with other top shields, such as, a top shield for a four wire pair or a top shield for a two wire pair. For example, a printed circuit board for an eight wire pair may use two top shields 572 and one top shield 672 on the top surface of the printed circuit board as shown in FIG. 20, and may use a top shield 272 on the bottom of the printed circuit board.

Referring to FIG. 20, the shield assembly 670 may include a top shield 672. The top shield 672 may be similar to top shield 572 except that the top shield 672 may be used with two wire pairs and the top shield 672 may include a bridge portion 687. The top shield 672 may include two sets of leads 683, 685 which may operate in a similar manner as the sets of leads 583, 585. The bridge portion 687 may connect together the two u-shaped portions for each wire pair. The bridge portion 687 may include an aperture 691. The apertures 691 may be used to solder the bridge portion 687 to the ground plane 651. In another embodiment, the apertures 691 may not be soldered.

Figure 23:
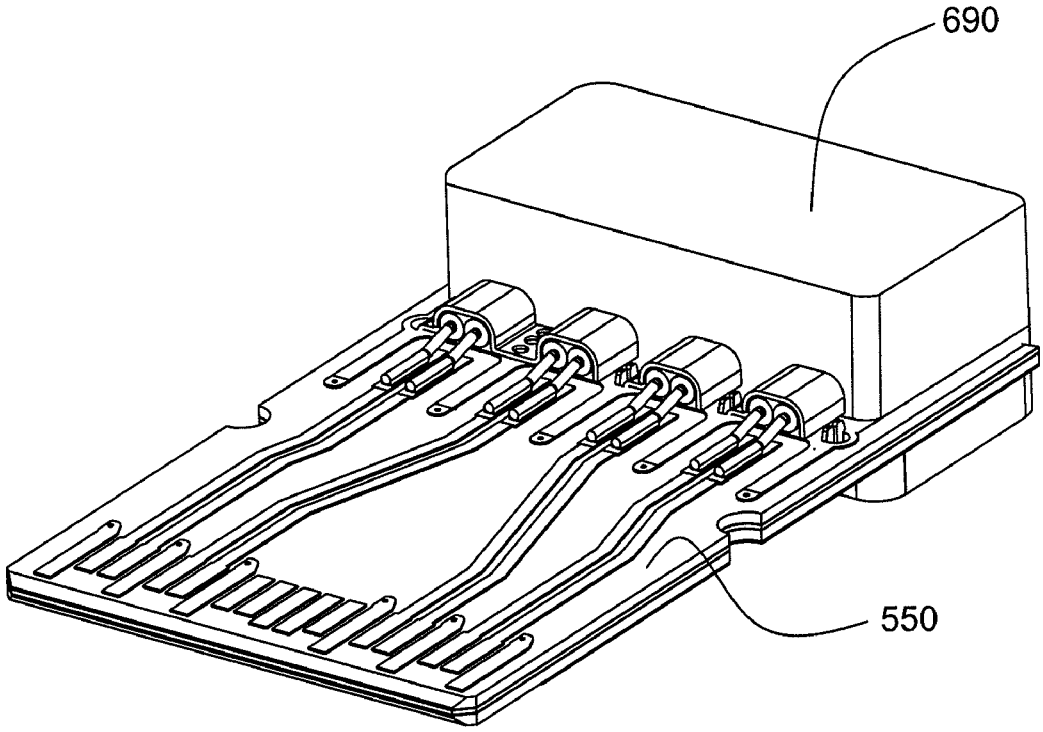
FIG. 23 is a perspective view of the cable assembly in FIG. 21 with overmold material.

Referring to FIG. 23, an overmold material 690 may be molded onto the printed circuit board 550. The overmold material may be a plastic. Referring to FIG. 20, the printed circuit board 550 may include apertures 696. The overmold material 690 may flow into the apertures 696 and may prevent the overmold material 690 from being separated from the printed circuit board 550.

Referring to FIG. 20, the printed circuit board 550 may include a drain wire mounting pad 698. The mounting pad 698 may provide a location for soldering a drain wire 686.

Figure 24:
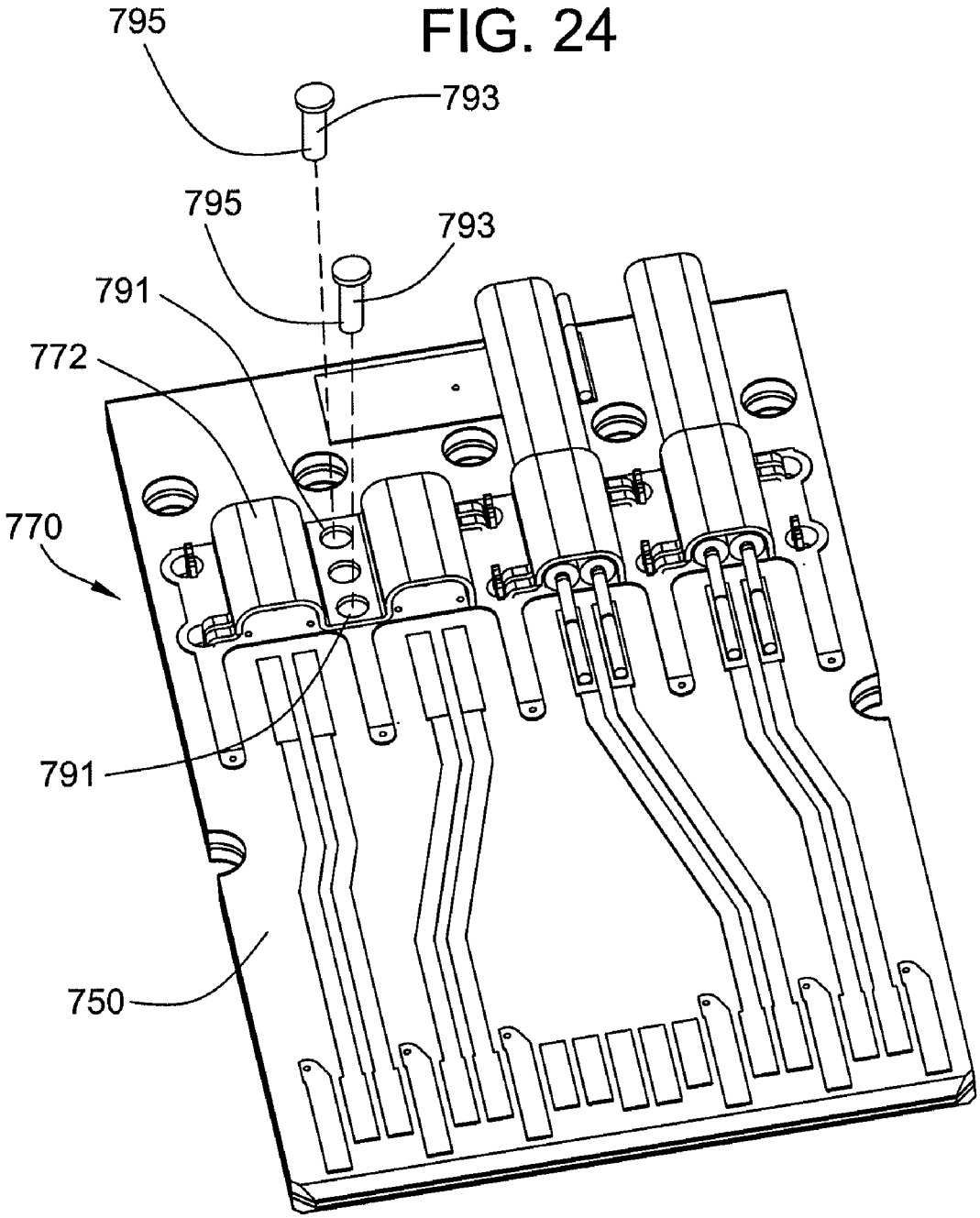
FIG. 24 is a perspective view of another embodiment of the cable assembly.

Referring to FIG. 24, another embodiment of a shield assembly 770 is shown. The top shield 772 is similar to top shield 672. In this embodiment, a pin 793 may be inserted into a hole 791. The printed circuit board 750 may include a hole to receive the pin 793. After the pin 793 is inserted into the holes, the end 795 of the pin 793 may be deformed to hold the pin 793 and the shield 772 in position.

Figure 25:
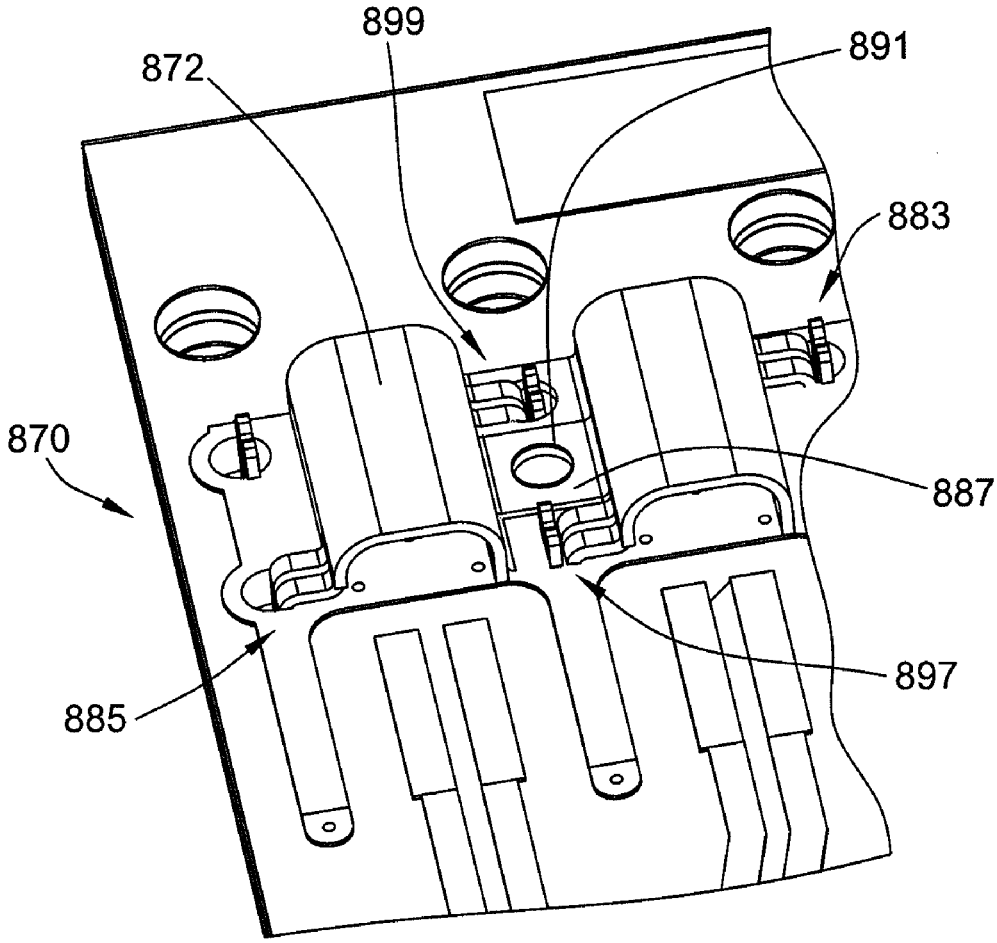
FIG. 25 is a perspective view of another embodiment of the cable assembly.

Referring to FIG. 25, another embodiment of a shield assembly 870 is shown. The top shield 872 is similar to top shield 672 except that top shield 872 may include four sets of leads 883, 885, 897, 899. The aperture 891 in the bridge portion 887 may be used for solder or a pin as described herein.

As noted herein, a top shield for two wire pairs may be used with other top shields, such as, a top shield for one wire pair, a top shield for a two wire pair and/or a top shield for a four wire pair.

Figure 26:
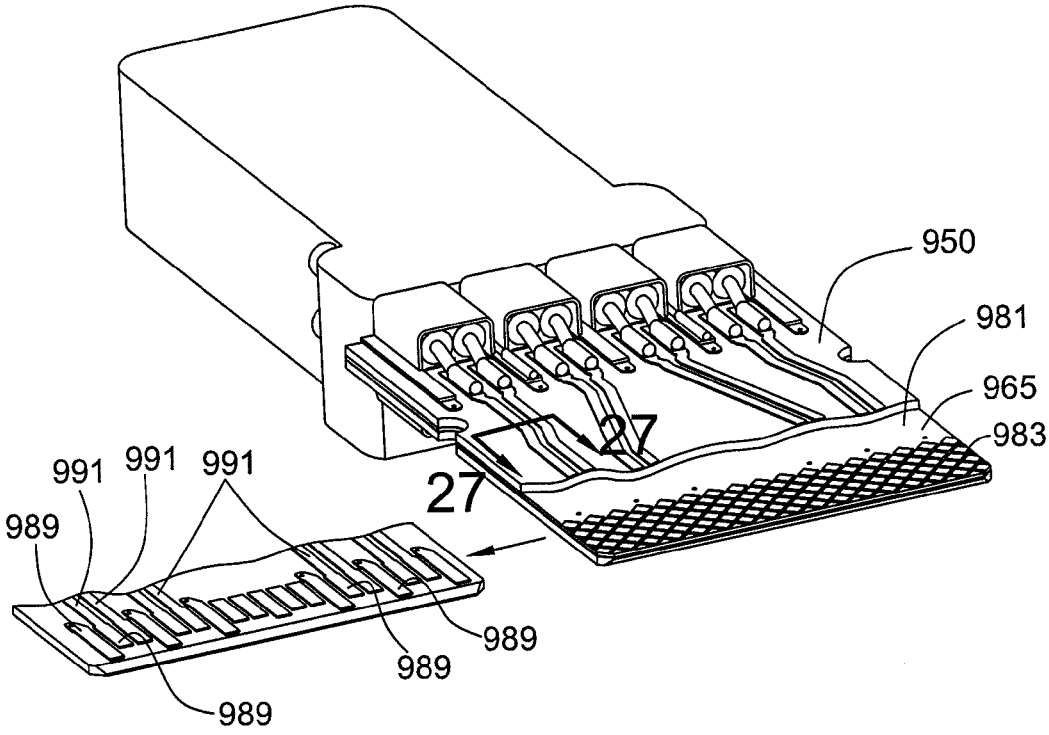
FIG. 26 is a perspective view of another embodiment of a cable assembly with a portion of the printed circuit board broken away.
Figure 27:
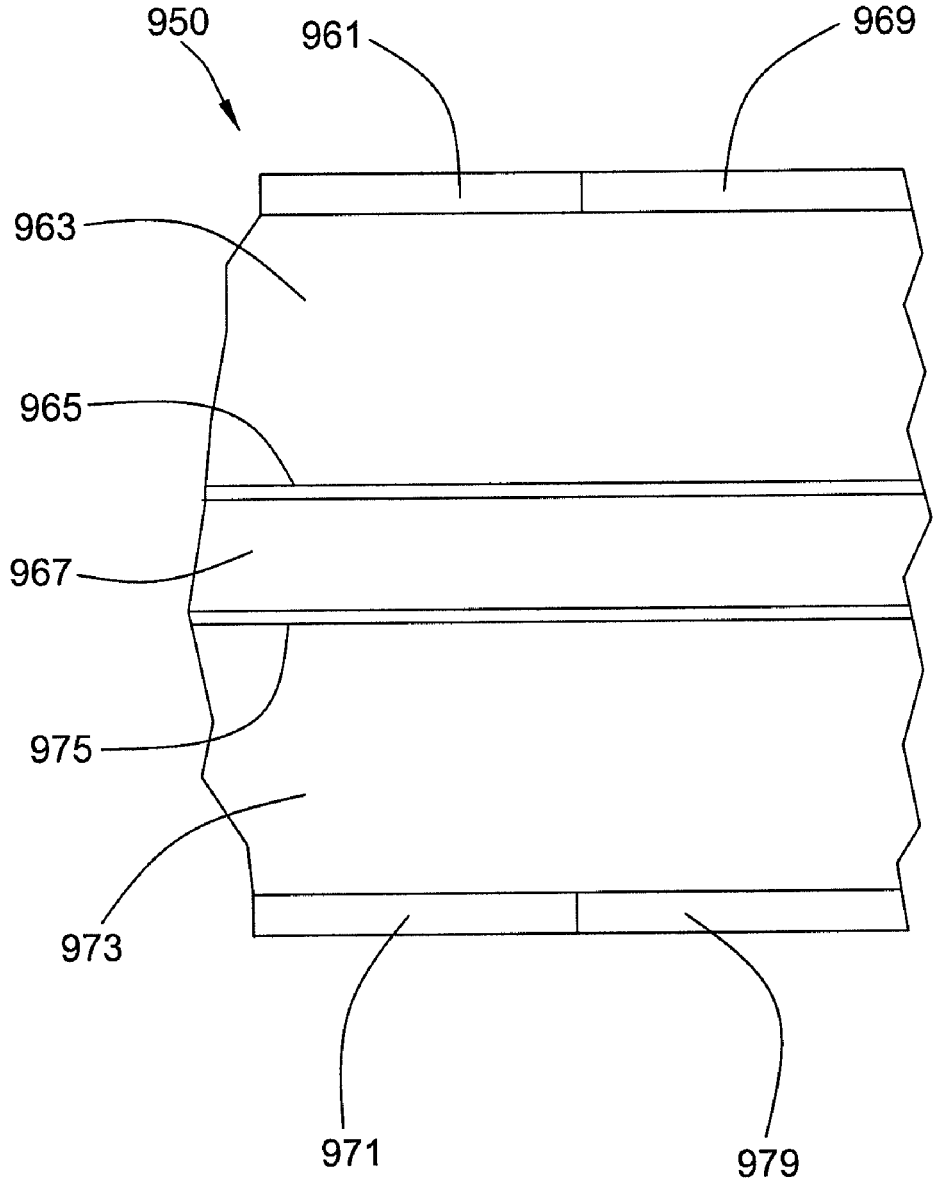
FIG. 27 is a cross-sectional view taken along line 27-27 of FIG. 26.

Referring to FIG. 26, the printed circuit board 950 may be made of several layers. Referring to FIG. 27, the printed circuit board 950 may have a trace layer 961, a core layer 963, a ground plane layer 965, a center layer 967, a trace layer 971, a core layer 973, and a ground plane layer 975. The trace layers 961, 971 and the ground plane layers 965,975 may be made of a conductive material, such as, copper. The core layers 963, 973 and the center layer 967 may be made of an insulative material, for example, a composite of a resin epoxy reinforced with a woven fiberglass mat, such as, FR408. The printed circuit board 950 may also include a solder mask layer 969 which is located around the trace layer 961. The printed circuit board 950 may include a solder mask layer 979 which may be located around the trace layer 971. In other embodiments, the printed circuit board may have more or less layers. For example, in other embodiments, the printed circuit board may have one or more trace layers, one or more core layers, and one or more ground layers.

Figure 28:
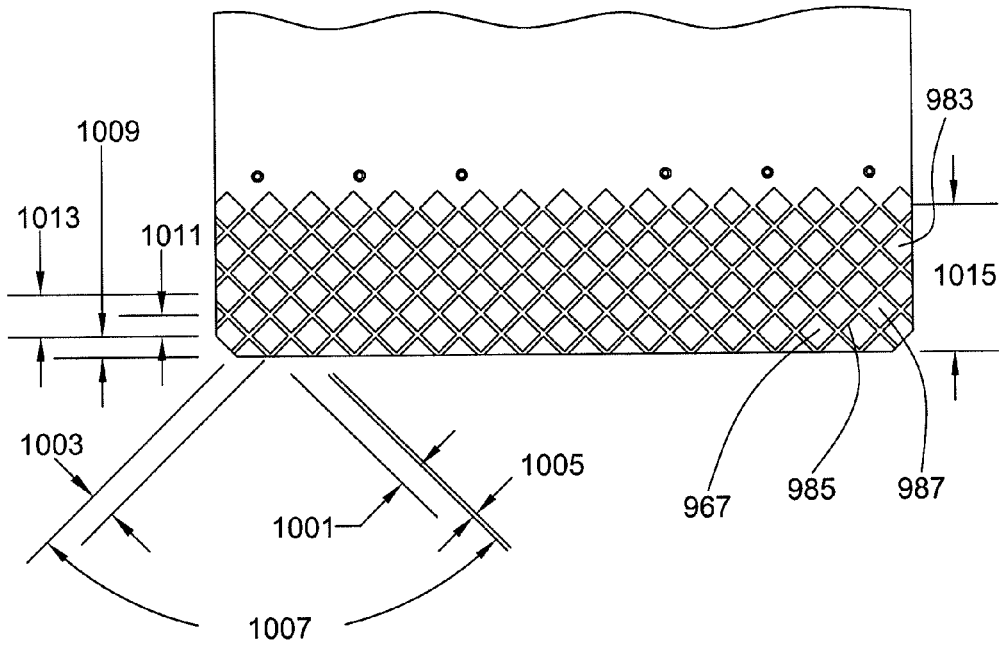
FIG. 28 is a partial top view of the printed circuit board.

Referring to FIG. 26, the ground plane layer 965 may have a portion 981 which is a solid layer and another portion 983 which is a non-solid layer. Referring to FIG. 28, the non-solid portion 983 may have portions 985 with a conductive material and other portions with openings 987, for example, with no conductive material. Thus, at the openings 987, the center layer 967 is located below these openings 987. The non-solid portion 983 may increase the impedance of the pads 989 which are located above the non-solid portion 983. Thus, referring to FIG. 26, smaller traces 991 may be used above the solid portion 981 of the ground plane and larger pads 989 may be used above the non-solid portion 983 of the ground plane so that the impedance may remain the same along the printed circuit board. In one embodiment, the traces 991 may have a width of about 0.45 mm and the pads 989 may have a width of about 0.6 mm. In another embodiment, the traces may have a first area per unit length and the pads may have a second area per unit length. The first area of unit length may be less than the second area per unit length.

Referring to FIG. 28, in one embodiment, the openings 987 have a square shape. The openings 987 may have a first dimension 1001. The first dimension 1001 may have a range from about 0.025 mm to about 1.27 mm. In one embodiment, the first dimension 1001 may be 0.6 mm. The openings 987 may have a second dimension 1003. The second dimension 1003 may have a first range from about 0.025 mm to about 1.27 mm. In one embodiment, the second dimension 1003 may be 0.6 mm. The portion 985 between the openings may have a dimension 1005. The dimension 1005 may have a first range from about 0.025 mm to about 1.27 mm. In one embodiment, the dimension 1005 may be 0.1 mm. The openings may have an angle 1007 between one side of the opening and an adjacent side of the opening. The angle 1007 may have a first range from about 1 degree to about 179 degrees. In one embodiment, the angle 1007 is 90 degrees. The center of the openings may be located a distance 1009 from the edge of the printed circuit board. The distance 1009 may have a range from about 0.025 mm to 1.27 mm. In one embodiment, the distance 1009 may be 0.495 mm. The center of the openings in the first row may be spaced a distance 1011 from the center of the openings in the second row. The distance 1011 may have a first range from about 0.025 mm to about 1.27 mm. In one embodiment, the distance 1011 may be 0.495 mm. The center of the openings in the first row may be spaced a distance 1013 from the center of the openings in the third row by a distance. The distance 1013 may have a first range of about 0.05 mm to about 2.54 mm. In one embodiment, the distance 1013 may be 0.990 mm. The non-solid layer portion 983 may have a distance 1015 from the edge of the printed circuit board to the center of the last row of openings. The distance 1015 may have a first range from about 0.127 mm to about 25.4 mm. In one embodiment, the distance 1015 may be 3.465 mm.

In other embodiments, the openings may have other shapes such as circles, ovals, parallelograms, rectangles, triangles or other polygons.

Figure 29:
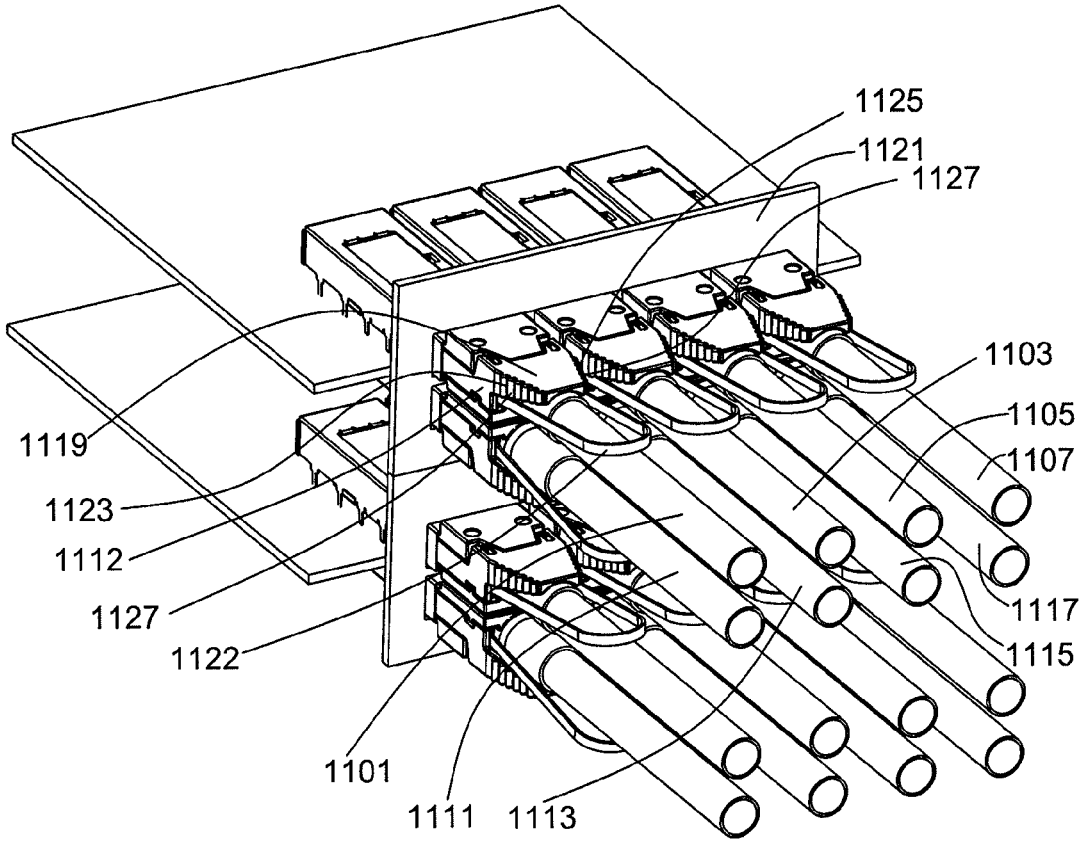
FIG. 29 is a perspective view of several cable assemblies mounted to a back plane.
Figure 30:
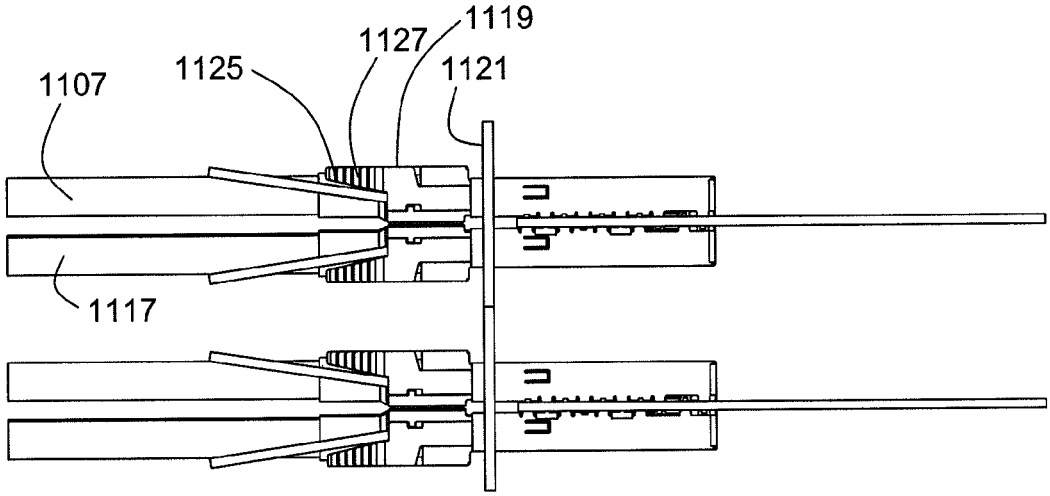
FIG. 30 is a side view of FIG. 29.

Referring to FIG. 29, several cable assemblies 1101, 1103, 1105 1107, 1111, 1113, 1115, 1117 may be connected to a back plane 1121 or to a motherboard which includes receptacles for the cable assemblies. In order to facilitate the insertion and/or removal of a cable assembly, the end portion 1119 of the cable assembly may include angled portions 1123, 1125. The angled portions 1123, 1125 allow the user to grasp the cable assembly for insertion and/or removal of the cable assembly. Without the angled portions, the cable assembly would have an end portion which is flat and which would be more difficult to push and/or grasp when the cable assemblies are close together. The angled portions 1123, 1125 may have a series of protrusions 1127. The protrusions 1127 may facilitate the pushing and/or grasping of the cable assembly. The end portion 1119 may be connected to the latch assembly 1112. The user may be able to move the latch assembly 1112 by pulling on the end portion 1119 or on the latch release 1122.

Figure 31:
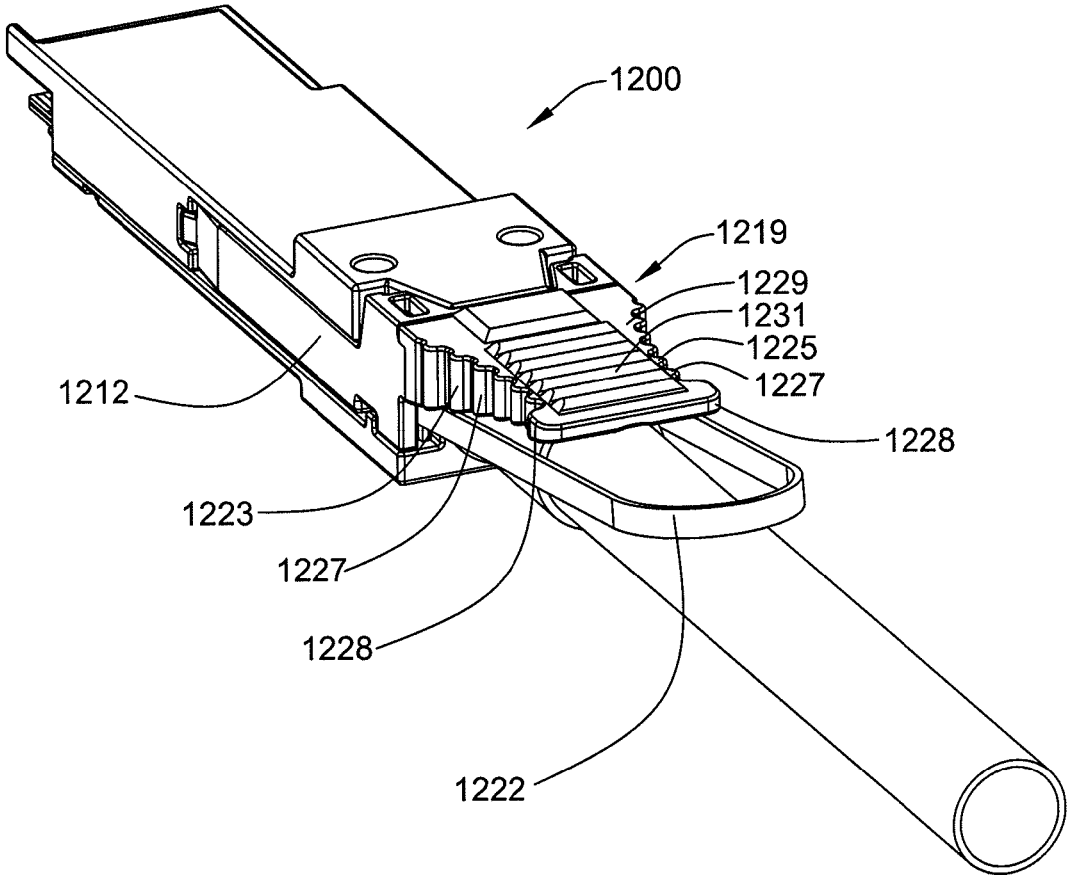
FIG. 31 is a perspective view of another embodiment of a cable assembly.
Figure 32:
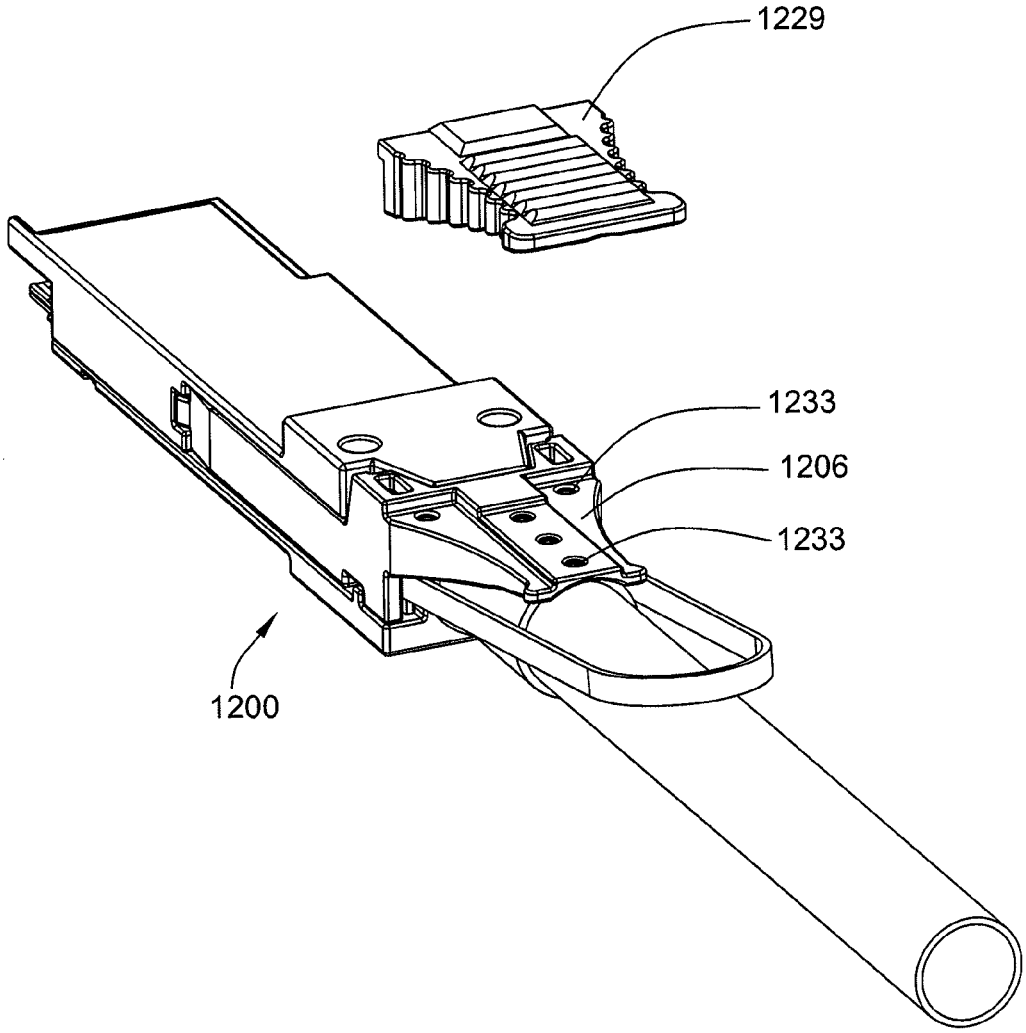
FIG. 32 is an exploded view of the cable assembly in FIG. 31.

FIGS. 31 and 32 show another embodiment of a cable assembly 1200. The cable assembly 1200 may be similar to the cable assemblies disclosed herein except that the cable assembly 1200 may include an end portion 1219 with overmold material 1229. The overmold material 1229 may be an insulative plastic material. Referring to FIG. 31, the end portion 1219 may be similar to the end portion 1119. The end portion 1219 may include angled portions 1223, 1225. The angled portions 1223, 1225 may include protrusions 1227. The angle portions 1223, 1225 may include protrusions 1228. The protrusions 1228 may be wider than the adjacent protrusion 1227 and may provide a surface for the user to push and/or grasp the cable assembly. The end portion 1219 may be connected to the latch assembly 1212. The user may be able to move the latch assembly 1212 by pulling on the end portion 1219 or on the latch release 1222. The top surface of the end portion 1219 may include a series of protrusions 1231. Referring to FIG. 32, the overmold material 1229 may be molded onto the back shell 1206. The back shell 1206 may include one or more detents 1233. The overmold material 1229 may flow into the detents 1233 and provide a better attachment of the overmold material 1229 to the back shell 1206. An end portion with overmold material may be used with any of the embodiments disclosed herein, as appropriate.

Referring to FIG. 33, another embodiment of a shield is shown. The shield 1372 may be similar to the shield 472 except that the shield 1372 may include one or more compliant pins 1392. The compliant pin may include two legs 1394, 1396 and an aperture 1398 between the legs 1394, 1396. The legs 1394, 1396 may be joined at the distal end. When the pin 1392 is inserted into the opening in a printed circuit board similar to the opening 577 in FIG. 20, the legs 1394, 1396 may deflect inward. The legs 1394, 1396 may apply an outward force on the opening to prevent removal of the shield 1372 from the printed circuit board. The compliant pin feature may be used with any of the embodiments disclosed herein, as appropriate.

Figure 34:
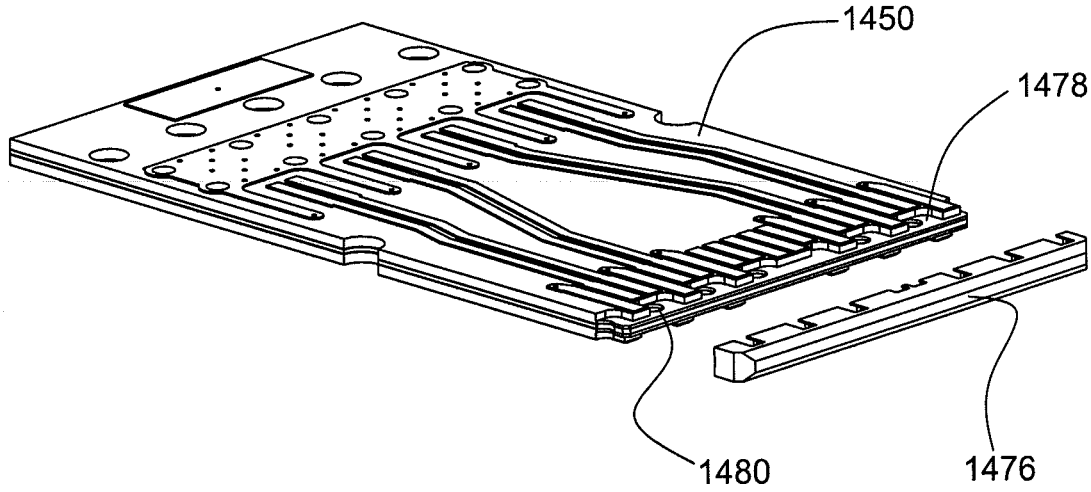
FIG. 34 is an exploded view of another embodiment.

Referring to FIG. 34, another embodiment of a printed circuit board 1450 is shown. The printed circuit board 1450 may include an overmold material 1476 at the front edge of the printed circuit board. The overmold material 1476 may be an insulative plastic material. The overmold material 1476 may be molded onto the front edge of the printed circuit board. The printed circuit board 1450 may have a portion 1478 of the front edge removed, such as, by machining. The overmold material 1476 may be molded onto the printed circuit board 1450 and may fill the removed portion 1478. The printed circuit board 1450 may include apertures 1480. The overmold material 1476 may flow into the apertures 1480 and may prevent the removal of the overmold material 1476. As noted with respect to FIG. 6, the overmold material 1476 may encapsulate the fibers on the edge of the printed circuit board in order to prevent fibers from separating from the edge. In addition, the overmold material 1476 may provide a transition between the printed circuit board edge and the pads.

Figure 35:
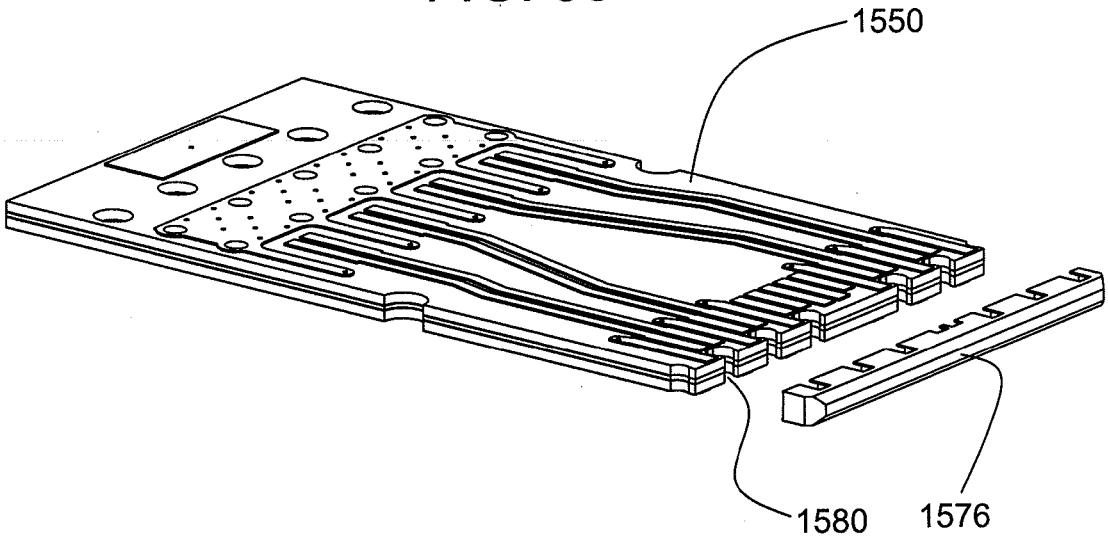
FIG. 35 is an exploded view of another embodiment.
Figure 36:
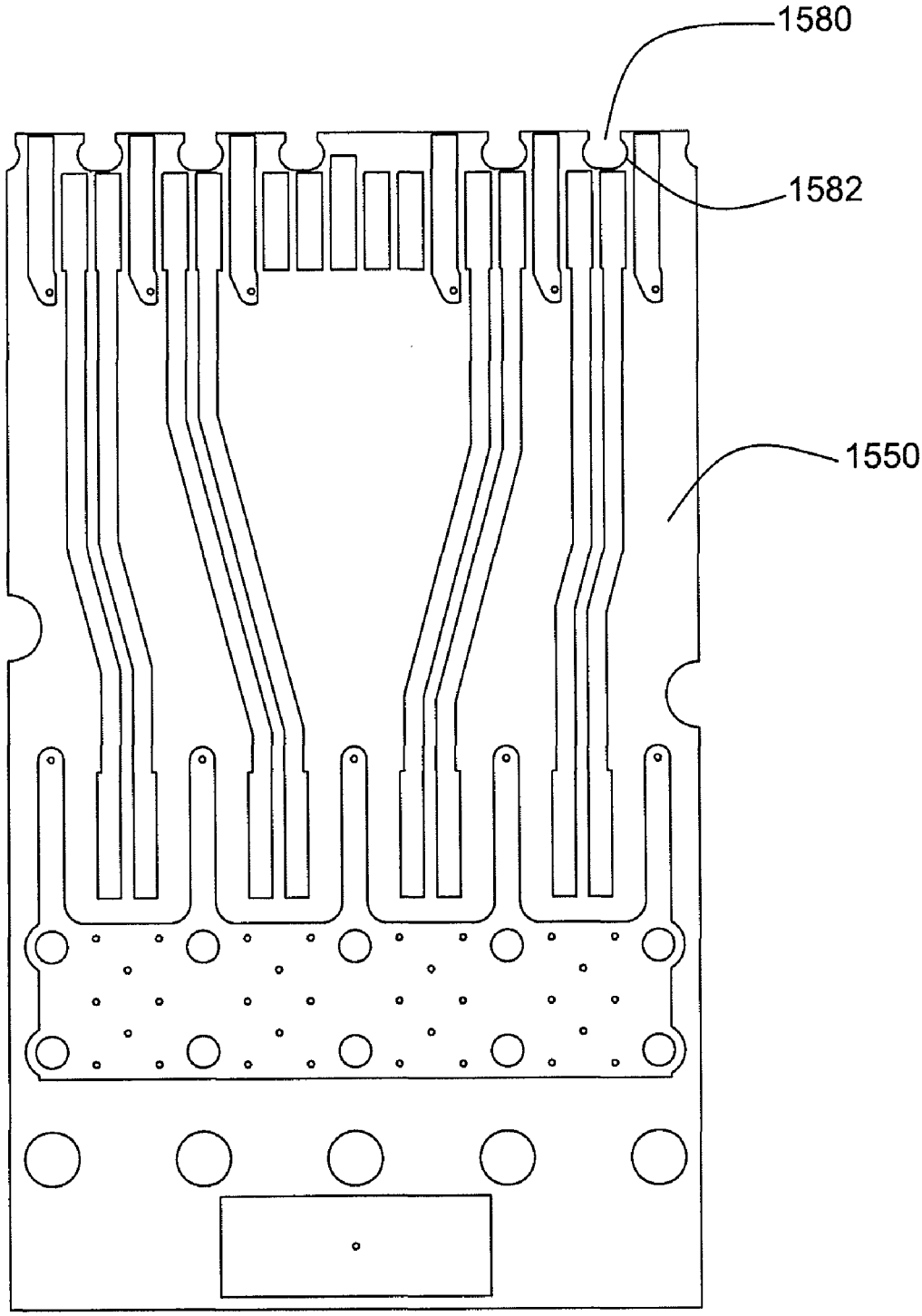
FIG. 36 is a top view of the printed circuit board in FIG. 35.

Referring to FIG. 35, another embodiment of a printed circuit board 1550 is shown. The printed circuit board 1550 may include an overmold material 1576 at the front edge of the printed circuit board. The overmold material 1576 may be an insulative plastic material. The overmold material 1576 may be molded onto the front edge of the printed circuit board. The printed circuit board 1550 may include apertures 1580. Referring to FIG. 36, the apertures 1580 may have a larger portion 1582 near the interior of the aperture 1580. The aperture may be in the shape of a key hole. The overmold material 1576 may flow into the apertures 1580 and may prevent the removal of the overmold material 1576. As noted with respect to FIG. 6, the overmold material 1576 may encapsulate the fibers on the edge of the printed circuit board in order to prevent fibers from separating from the edge. In addition, the overmold material 1576 may provide a transition between the printed circuit board edge and the pads. In another embodiment, the printed circuit board may have a portion of the front edge removed, similar to FIG. 34. The overmold material may be molded onto the printed circuit board and may fill the removed portion.

Figure 37:
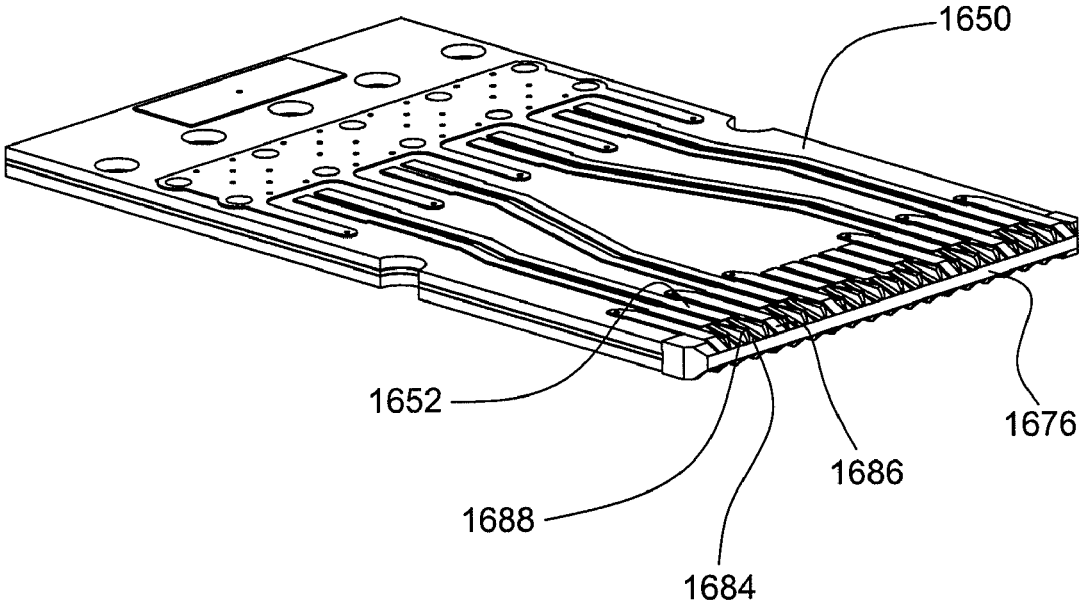
FIG. 37 is a perspective view of another embodiment.
Figure 38:
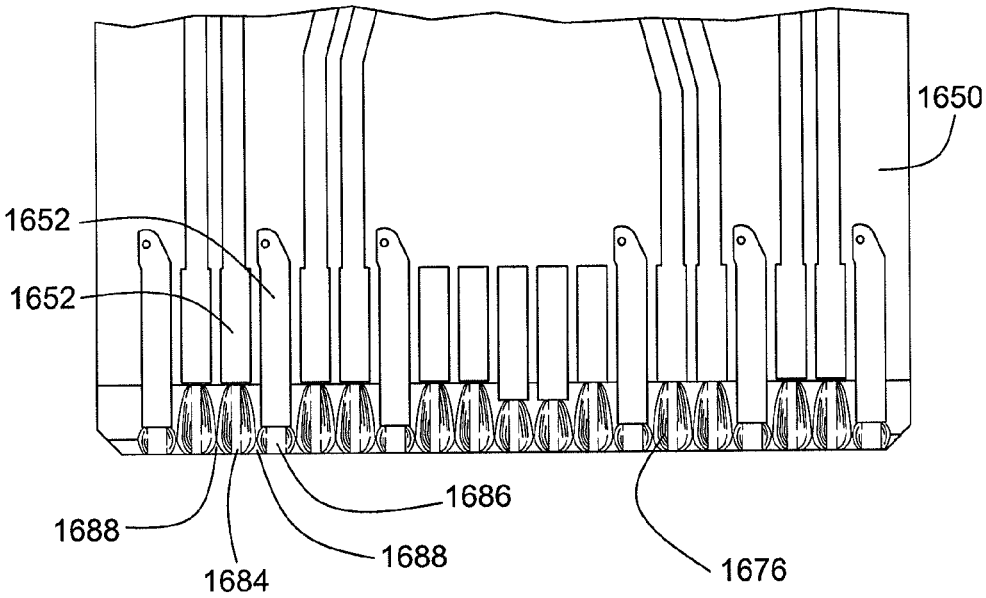
FIG. 38 is a top view of the printed circuit board in FIG. 37.

Referring to FIGS. 37 and 38, another embodiment of a printed circuit board 1650 is shown. The printed circuit board 1650 may include an overmold material 1676 at the front edge of the printed circuit board. The overmold material 1676 may be an insulative plastic material. The overmold material 1676 may be molded onto the front edge of the printed circuit board. The overmold material may include ramps 1684, 1686. The ramps 1684, 1686 may be used to guide the contacts of the mating receptacle onto the pads 1652 on the printed circuit board 1650. The signal ramps 1684 may be used to guide the signal contacts and the ground ramps 1686 may be used to guide the ground contacts. The signal ramps 1684 may be longer than the ground ramps 1686 due to the distance of the respective pads from the edge of the printed circuit board. The angle of the signal ramps 1684 may be less than the angle of the ground ramps 1686. The ramps 1684, 1686 may be curved and may include sidewalls 1688. The sidewalls 1688 may assist in aligning the contacts with the pads 1652. As noted with respect to FIG. 6, the overmold material 1676 may encapsulate the fibers on the edge of the printed circuit board in order to prevent fibers from separating from the edge. In addition, the overmold material 1676 may provide a transition between the printed circuit board edge and the pads. The printed circuit board 1650 may include apertures, similar to the apertures in FIG. 34 and/or FIGS. 35-36. The overmold material 1676 may flow into the apertures and may prevent the removal of the overmold material 1676. The printed circuit board may have a portion of the front edge removed, similar to FIG. 34. The overmold material may be molded onto the printed circuit board and may fill the removed portion.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A cable assembly comprising a cable including a pair of wires, a housing, a printed circuit board within the housing, the pair of wires attached to the printed circuit board, the printed circuit board includes a substrate and a conductive pad on a surface of the substrate, the substrate has an edge, the conductive pad is located near the edge of the substrate, a material is located on the edge of the substrate, the printed circuit board includes third conductive pads, the wires include a wire shielding and wire insulation, the wires are attached to the third conductive pads, the wires include an unshielded portion with the wire shielding removed from the wire insulation, the unshielded portion is located near the third conductive pads, and second shielding is located at the unshielded portion to provide shielding for the wire pair, the second shielding includes a top shield and an intermediate shield.

2. The cable assembly of claim 1 wherein the material covers the edge of the substrate.

3. The cable assembly of claim 1 wherein the material is less abrasive than the edge of the substrate.

4. The cable assembly of claim 1 wherein the material is a coating.

5. The cable assembly of claim 4 wherein the edge of the substrate is chamfered.

6. The cable assembly of claim 4 wherein the conductive pad is free of the material.

7. The cable assembly of claim 4 wherein the coating is selected from the group consisting of: a conformal coating, a paint, an acrylic, a silicone, a polyurethane, a urethane, an ultra-violet cured coating, a water based coating, a fluoro-acrylic, a physical vapor deposition coating, a chemical vapor decomposition coating, and a urethane acrylate.

8. The cable assembly of claim 1 wherein the material is a plastic.

9. The cable assembly of claim 1 wherein the substrate has an end, the material provides a transition between the end of the substrate and the conductive pad.

10. The cable assembly of claim 1 wherein the printed circuit board includes a second conductive pad.

11. The cable assembly of claim 10 wherein the printed circuit board has a first side and a second side, the conductive pad and the second conductive pad are located on the first side of the printed circuit board.

12. The cable assembly of claim 10 wherein the printed circuit board has a first side and a second side, the conductive pad is located on the first side of the printed circuit board and the second conductive pad is located on the second side of the printed circuit board.

13. The cable assembly of claim 1 wherein the printed circuit board includes a trace, the trace extends between the conductive pad and one of the third conductive pads.

14. The cable assembly of claim 1 wherein the printed circuit board includes a ground layer.

15. The cable assembly of claim 1 wherein the printed circuit board includes a trace, the printed circuit board includes a ground layer, the ground layer includes a solid portion and a non-solid portion, the conductive pad is located above the non-solid portion of the ground layer, and the trace is located above the solid portion of the ground layer.

16. The cable assembly of claim 1 wherein the cable assembly includes a latch assembly.

17. The cable assembly of claim 1 wherein the housing includes an end portion, and the end portion includes angled portions.

18. The cable assembly of claim 1 wherein the second shielding provides shielding around the unshielded portion of the wire pair.

19. The cable assembly of claim 18 wherein the second shielding provides 360 degrees of shielding around the unshielded portion of the wire pair.

20. The cable assembly of claim 1 wherein the cable includes a second pair of wires, the second pair of wires include a wire shielding and wire insulation, the second pair of wires are attached to the third conductive pads, the second pair of wires include a second unshielded portion with the wire shielding removed from the wire insulation, the second unshielded portion is located near the third conductive pads, and second shielding is located at the second unshielded portion to provide shielding for the second pair of wires.

21. The cable assembly of claim 1 wherein the top shield is attached to the printed circuit board.

22. The cable assembly of claim 1 wherein the material is molded onto the printed circuit board.

23. The cable assembly of claim 22 wherein the printed circuit board includes an aperture, the material is located in the aperture.

24. The cable assembly of claim 1 wherein the printed circuit board includes a removed portion, the material is located in the removed portion.

25. The cable assembly of claim 1 wherein the edge of the substrate is chamfered.

26. The cable assembly of claim 1 wherein the conductive pad is free of the material.

* * * * *